US011684541B2

(12) United States Patent
Paradis

(10) Patent No.: US 11,684,541 B2
(45) Date of Patent: Jun. 27, 2023

(54) DEVICES AND METHODS FOR ACTIVE DECOMPRESSION OF THE CHEST DURING CIRCUMFERENTIAL CONSTRICTION CARDIOPULMONARY RESUSCITATION

(71) Applicant: CPR Therapeutics, Inc., Putney, VT (US)

(72) Inventor: Norman Alan Paradis, Putney, VT (US)

( * ) Notice: Subject to any disclaimer, the term of this patent is extended or adjusted under 35 U.S.C. 154(b) by 189 days.

(21) Appl. No.: 17/020,647

(22) Filed: Sep. 14, 2020

(65) Prior Publication Data

US 2021/0059900 A1 Mar. 4, 2021

Related U.S. Application Data

(63) Continuation-in-part of application No. 15/180,964, filed on Jun. 13, 2016, now Pat. No. 10,772,793.

(60) Provisional application No. 62/174,839, filed on Jun. 12, 2015.

(51) Int. Cl.
*A61H 31/00* (2006.01)

(52) U.S. Cl.
CPC ..... *A61H 31/005* (2013.01); *A61H 31/006* (2013.01)

(58) Field of Classification Search
CPC ..... A61H 31/00–008; A61H 9/0078; A61H 9/0092; A61H 11/00–02; A61H 2201/013; A61H 2201/1246; A61H 2205/084
See application file for complete search history.

(56) References Cited

U.S. PATENT DOCUMENTS

| | | | | |
|---|---|---|---|---|
| 4,928,674 A * | 5/1990 | Halperin | ..... | A61H 31/008 600/510 |
| 2010/0004572 A1* | 1/2010 | King | ..... | A61H 31/008 601/41 |
| 2012/0016179 A1* | 1/2012 | Paradis | ..... | A61H 9/0078 601/41 |
| 2014/0155792 A1* | 6/2014 | Karve | ..... | A61H 9/0078 601/41 |

* cited by examiner

*Primary Examiner* — Rachel T Sippel
(74) *Attorney, Agent, or Firm* — Nathaniel A. Wickliffe

(57) ABSTRACT

The present invention is a method for improving hemodynamics and clinical outcome of patients suffering cardiac arrest and other low-flow states by combination of circumferential constriction and anteroposterior compression decompression of the chest cardiopulmonary resuscitation. Anteroposterior compression decompression may be provided by a piston mechanism attached to a gantry above the patient. Circumferential constriction may be achieved by inflation of pneumatic bladders or shortening of a band. The on-off sequence and relative force of circumferential constriction and anteroposterior compression decompression may be adjusted so as to improve efficacy.

17 Claims, 17 Drawing Sheets

DEVICES AND METHODS FOR ACTIVE DECOMPRESSION OF THE CHEST DURING CIRCUMFERENTIAL CONSTRICTION CARDIOPULMONARY RESUSCITATION

RELATED APPLICATIONS

This application is a continuation-in-part of co-pending U.S. patent application Ser. No. 15/180,964, filed Jun. 13, 2019, entitled MECHANICAL CARDIOPULMONARY RESUSCITATION COMBINING CIRCUMFERENTIAL CONSTRICTION AND ANTEROPOSTERIOR COMPRESSION OF THE CHEST, which claims the benefit of co-pending U.S. Provisional Application Ser. No. 62/174,839, entitled MECHANICAL CARDIOPULMONARY RESUSCITATION COMBINING CIRCUMFERENTIAL CONSTRICTION AND ANTEROPOSTERIOR COMPRESSION OF THE CHEST, filed Jun. 12, 2015, the entire disclosure of each of which applications is herein incorporated by reference.

FIELD OF THE INVENTION

The invention disclosed herein relates in general to the field of medical devices used for cardiopulmonary resuscitation (CPR) of patients suffering cardiac arrest or shock, and more particularly, to devices that provide or enhance hemodynamics during CPR.

BACKGROUND OF THE INVENTION

It is possible to induce forward blood flow to during cardiac arrest by application of external force to the thorax. (Kouwenhoven, Jude, and Knickerbocker 1064-67) Most commonly, this has been achieved by providing anteroposterior compression of the mid-chest in the area of the sternum, either manually or mechanically with a piston like mechanism.

The specific mechanisms by which external chest compression achieves forward blood flow remains unclear. Two competing theories have been proposed, the cardiac pump mechanism and the thoracic pump mechanism. It is generally believed that anteroposterior compression of the sternum achieves forward blood flow principally through the cardiac pump mechanism, (Rudikoff et al. 345-52) and that circumferential constriction CPR functions through the thoracic pump. (Niemann et al. 141-46)

The failure to differentiate between these two theories may reflect the possibility that both mechanisms can contribute to forward blood flow. Either the cardiac or thoracic mechanism may be more or less predominant in any given patient depending on their body habitus and individual physiology.

It has been demonstrated that, compared to classical anteroposterior compression, circumferential constriction may be associated with higher intrathoracic pressure changes, greater blood flow, and increased rates of return of spontaneous circulation. (Halperin et al. 2214-20) Typically, such constriction is generally achieved by inflation of a circumferential pneumatic bladder, or semi-circumferentially with a band. (Halperin et al. 2214-20)

The efficacy of anteroposterior compression may be improved by the addition of forceful decompression during the upstroke of the piston. (Plaisance, Lurie, and Payen 989-94) Such active decompression requires attachment of the piston device to the chest. Typically, this is achieved by use of a suction cup device at the end of the piston.

The improvement in hemodynamics associated with active decompression may be mechanistically mediated by creation of increased negative intrathoracic pressure during the decompression phase of CPR, with resulting enhancement of venous return. Additional enhancement of negative intrathoracic pressure and venous return may be achieved by briefly obstructing the airway during the decompression release phase. (Aufderheide et al. 734-40; Plaisance et al. 990-94) Typically, this is achieved through utilization of a cracking valve mechanism called an impedance threshold device.

Although circumferential constriction devices may have advantages over anteroposterior compression devices, they do not allow for active decompression or optimize airway impedance threshold devices.

Additional interventions that may improve either circumferential constriction or anteroposterior compression of the chest include adjunctive therapy with pressor drugs, techniques that actively compress or decompress the abdomen, (Ralston, Babbs, and Niebauer 645-51) techniques that synchronize components with residual cardiac function, (Paradis et al. 1287-91) among others.

Since its first description, external chest compression as a therapy for cardiac arrest, and in particular sudden death, has been extensively studied, and numerous refinements have occurred. (CARDIAC ARREST—The Science and Practice of Resuscitation Medicine). Despite this significant effort, a large majority of patients suffering sudden death will not be successfully resuscitated to discharge from the hospital capable of independent function. This is even true for patients whose cardiac arrest occurs within the hospital and who receive immediate therapy. The inability of medical science to improve the efficacy of resuscitative treatment is one of the great enigmas in modern medicine. (Paradis 97-99)

From its inception, mechanical CPR has been bifurcated into devices that provide anteroposterior compression of the sternum, (Barkalow 509) and devices that utilize circumferential constriction for all or a portion of the chest. (Ong et al. 2629-37) Prior to this disclosure, it has not been appreciated that a more effective method might incorporate a combination of anteroposterior compression of the sternum and circumferential constriction of the remainder of the chest. Such a method would engage both the cardiac pump and thoracic pump hemodynamic mechanisms. The failure to combine these differing approaches may underlie the inability to improve the efficacy of cardiopulmonary resuscitation.

Devices for providing anteroposterior compression CPR are well known. (McDonald 292-95) (Barkalow 509) Generally, these are piston based devices, with the piston held in position anterior to the patient by a structural arm or arch that acts like a gantry.

Devices for providing circumferential and partial circumferential constriction CPR are well known. (Halperin et al. 762-68) Generally, these incorporate either a band around the front and sides of the patient, or a pneumatic bladder with a constricting outer circumference. In either case, force is applied to the thorax in a circumferential or semi-circumferential manner.

Devices for providing forceful anteroposterior decompression are well known. (Cohen et al. 2916-23) Devices to enhance negative intrathoracic pressure and venous return are well known. (Plaisance, Lurie, and Payen 989-94).

There do exist devices (US20070010765 A1) that are circumferential or semi-circumferential and that incorporate a bladder anterior to the patient such that a portion of the circumferential force may create some anteroposterior compression. However, this effect is passive and is likely not associated with greater force in the anteroposterior compression vector than in any other of the radial circumferential constriction vectors.

Previous to this disclosure, it has not been appreciated that a device combining anteroposterior compression and circumferential constriction may provide enhanced hemodynamics and clinical efficacy. Such an approach is absent from the medical and intellectual property literature. Additionally absent are any of the specific relationships between the circumferential constriction and anteroposterior compression mechanism's that may optimize efficacy.

Circumferential constriction cardiopulmonary resuscitation (CPR), wherein compressive force is applied around the chest, can be more effective than standard sternal compression at generating forward blood flow. It is also possible to combine standard sternal compression CPR with circumferential constriction CPR. In various embodiments, circumferential constriction CPR can be provided by Vest CPR, where a bladder-containing garment (similar to a large blood pressure cuff) is placed around the chest, and the vest can be cyclically inflated by a pneumatic drive system. In various embodiments, circumferential constriction CPR can also be provided by belt CPR, wherein a belt is placed around the thorax with the belt's circumference cyclically decreased and relaxed.

SUMMARY OF THE INVENTION

The present disclosure describes a method for improving CPR hemodynamics and clinical outcome of patients suffering cardiac arrest and other low-flow states by combination of circumferential constriction and anteroposterior compression of the chest. The efficacy of the method may be further enhanced by providing active decompression of the chest and full or partial obstruction of the airway during portions of decompression.

The component providing anteroposterior compression of the precordium can be a powered piston mechanism attached to a gantry above the patient.

Circumferential constriction of the chest may be achieved in any number of ways including, but not limited to, inflation of a pneumatic device, inflation of a series of pneumatic chambers, shortening of a band device, or a combination of pneumatic chambers and inflexible bands.

The circumferential constriction and anteroposterior compression of the chest may be simultaneous or in a fixed phasic relationship that is not simultaneous. Such a system allows optimization of hemodynamics by variance of the timing and force of each component within each on-off CPR cycle.

The component performing anteroposterior compression of the chest may be attached to the component providing circumferential constriction. As such, they may share force. Alternatively, force may be applied preferentially to one of the two components. In a particular embodiment, the force and movement applied to sternal structures by the anteroposterior compression mechanism may be greater than the force applied elsewhere to the chest by the circumferential constriction mechanism.

In certain embodiments, a mechanism attaches the anteroposterior compression mechanism to the patient's anterior chest for provision of forceful anteroposterior decompression. Such mechanism may be a suction cup attached to the patient side of the piston, or even incorporated into the piston itself.

Generally, it is anticipated the mechanical or pneumatic force for circumferential constriction and anteroposterior compression of the chest can be provided by electrical, mechanical or pneumatic subsystems alone or in combination.

The circumferential or semi-circumferential constriction can be provided by a band alone, a band that has inflatable pneumatic chambers on all or portion of its inner circumference, a circumferential pneumatic bladder or series of bladders, or a combination of pneumatic platters and belts, or other possibilities that can include the vest described further below.

The invention allows application of differential force to one portion of the chest compared to another. This can result in differing portions to be compressed or constricted further toward the center of the patient's chest. In various embodiments, 1) the circumferential constriction mechanism and the anteroposterior compression mechanism can both initiate simultaneously, 2) the circumferential constriction mechanism can complete its constriction before the anteroposterior compression mechanism completes its compression, 3) and the anteroposterior compression can continue longer with greater force so as to move the sternal structures closer to the center of the patient's chest than other portions of the chest.

Forward blood flow during CPR may be enhanced by increased venous return, which may in turn be enhanced by increased negative intrathoracic pressure during the CPR relaxation phase. Enhanced negative intrathoracic pressure may be achieved by forceful outward decompression of the chest. Existing methods and devices for circumferential constriction CPR do not provide active decompression of the chest.

Efficacy of CPR can be increased by improving venous return, so that more blood is available for cardiac output. Active decompression can provide improved venous return by helping to pull blood back to the heart. Pulling outwards on the patient's thorax in between constrictions can provide the active decompression to increase venous return. In embodiments of mechanical CPR that include pneumatic circumferential constriction, active decompression of the chest can be achieved by active deflation of the vest, which can result in forces pulling outward on the thorax. In various embodiments, a circumferential constriction member can be anchored to a structural cuirass so that the circumferential member can pull outwards on the patient's thorax during decompression. In various embodiments, the structural cuirass may be achieved by way of an inflatable bladder that fills to rigidity and does not cycle its internal pressure. Such a pneumatic bladder cuirass may be inflated from the same pneumatic drive system that actively inflates and actively deflates the circumferential constriction CPR vest. Placement of one way valve between the circumferential constriction CPR pneumatic system and the pneumatic bladder cuirass would act to automate inflation of the pneumatic bladder cuirass at the start of CPR.

In various embodiments, a device to provide forceful decompression of the thorax during circumferential constriction CPR can include a circumferential pneumatic bladder vest surrounding the thorax of the patient, a pneumatic drive unit for the provision of forceful inflation of the vest, a pneumatic drive unit for provision of forceful deflation, and a structural cuirass.

BRIEF DESCRIPTION OF THE DRAWINGS

The invention description below refers to the accompanying drawings, of which.

DETAILED DESCRIPTION

The present disclosure includes a system, method, or device intended generally to improve hemodynamics and clinical outcome of patients suffering cardiac arrest, or other low-flow states. This can include providing CPR that is a combination of circumferential constriction and anteroposterior compression. This can include providing CPR that includes active decompression to improve venous return of blood to the heart.

It is anticipated that the system can include multiple components.

Figure 1:
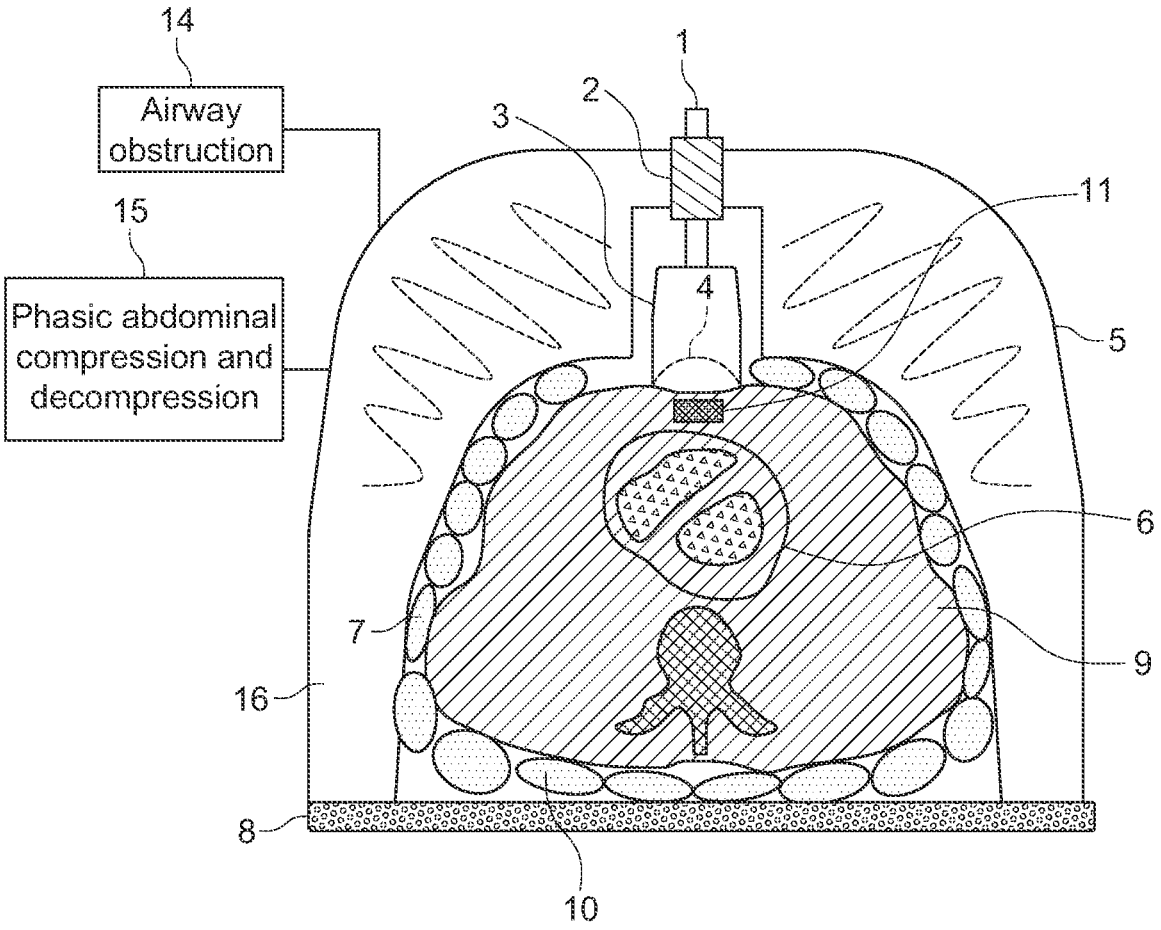
FIG. 1 is a cross sectional view of patient, gantry, anteroposterior compression mechanism, multi-bladder pneumatic circumferential constriction mechanism and backboard.
Figure 2:
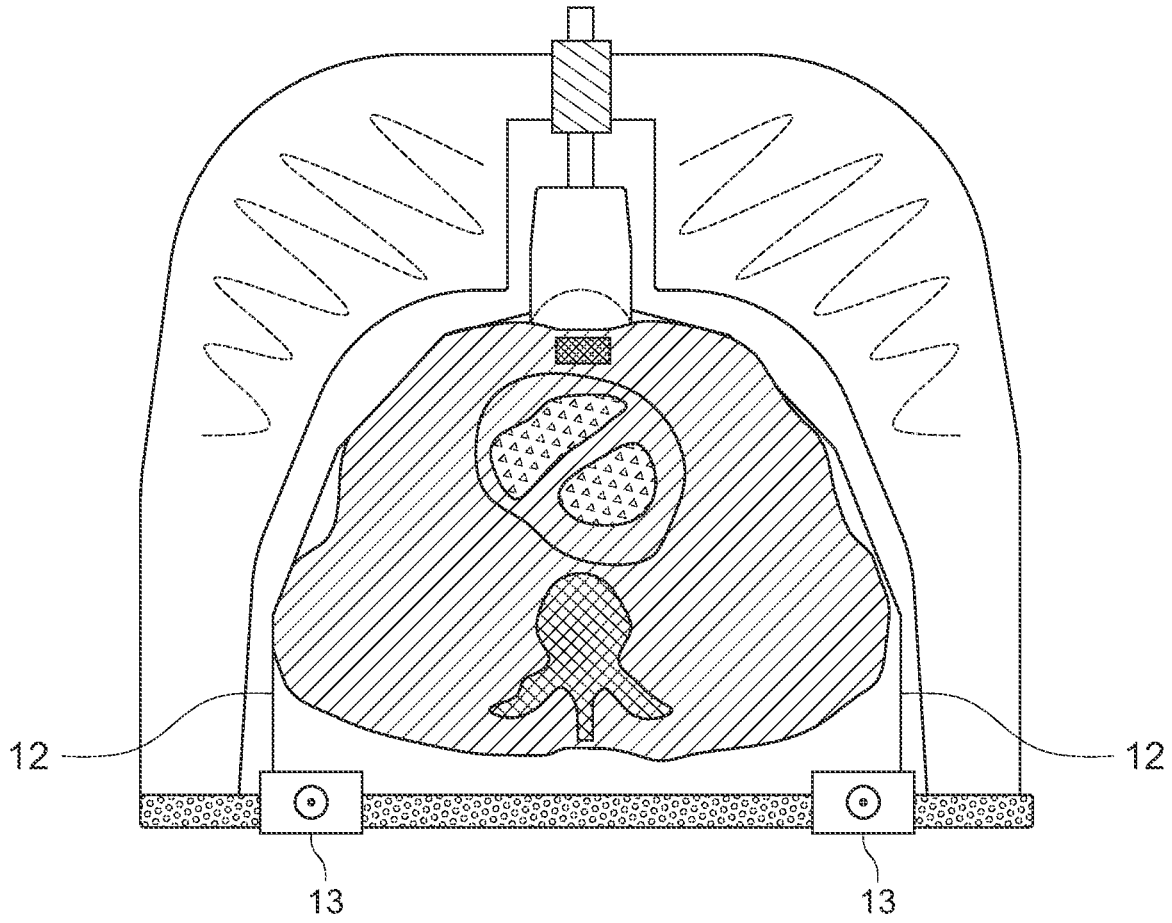
FIG. 2 is a cross sectional view of patient, gantry, anteroposterior compression mechanism, belt-band circumferential constriction mechanism, roller motors, and backboard.

In one embodiment, a non-limiting example of the system and method can include the following features shown in FIGS. 1 and 2:

1. A backboard of sorts 8 to maintain the patient's chest 9 in the optimal configuration with respect to the other components.
2. A piston like device 1, 2, 3 for provision of anteroposterior compression of the patient's chest.
3. A mechanism to attach the piston 3 to the patient's chest 9 for provision of forceful decompression 3, 4. This may be a suction cup or similar device.
4. A structural gantry or arch 5 anterior to or above the patient for holding the piston in position.
5. A circumferential, or semi-circumferential band 12 or pneumatic bladder or bladders 7, 10 for provision of circumferential constriction.
6. A method or methods to provide force or energy to the components that provide anteroposterior compression and circumferential constriction, both for the piston mechanism 2 and the circumferential mechanism 13.

There are components of the invention that, while sufficient, are interchangeable within the context of the invention. Various embodiments of these components can be utilized in optimizing performance of the invention.

For purposes of illustration and not limitation, various embodiments can also include, by way of non-limiting example:

A hinged backboard 8 capable of changing the geometric relationship or relationships between the head, patient's chest 9, abdomen and extremities.

A section of circumferential pneumatic constrictor may be applied to a portion of the backboard next to the posterior aspect of the patient's chest 10.

The gantry may be adjustable as to shape, so as to maximize the application and effectiveness of the pneumatic constrictor function with respect to the patient's chest. The gantry may be adjustable as to location over the patient such that the location and vector of the anteroposterior compression mechanism are adjustable.

Adjustable vertical lateral struts on either side of the patient's chest, each with a section of circumferential pneumatic constrictor between the strut and the patient's lateral chest. This may be adjustable as to shape and location, so as to maximize the application and effectiveness of the pneumatic constrictor function chamber to the patient's chest.

A band device 12 capable of wrapping around the patient's anterior and lateral chest and contributing to both anteroposterior compression and circumferential constriction. A section of circumferential pneumatic constrictor system might be applied to a portion of the band so as to further enhance efficacy. This may be adjustable as to shape, so as to maximize the application and effectiveness of the pneumatic constrictor function chamber to the patient's chest. The band itself 12 may be attached to a motor 13 or mechanical device, such that it's length may be forcibly shortened to create chest constriction.

A piston component 3 capable of anteroposterior compression of the chest. This can be attached to a motor 2, mechanical or pneumatic device at a point sagittal and centrifugal to the patient, most likely above the mid-anterior chest. The attachment to the gantry 5 and the gantry itself may be adjustable so as to allow change in the vector force of the piston. The patient side of the piston would be capable of attachment to the patient's chest such that the piston could apply upward decompressive force, so called active decompression. This could be accomplished by a suction cup or adhesive component 3, 4.

A mechanical system capable of sending force to the constricting band 12, 13 and piston 1, 3.

A pneumatic system capable of sending inflation-deflation to the chambers of the pneumatic circumferential constricting system 7.

A feedback control component capable of utilizing indicators of tissue perfusion and varying the parameters of the compression and constricting systems so as to improve tissue perfusion and the probability of successful resuscitation.

A control component capable of varying the force or timing of chest compression or constriction so as to increase the likelihood that electrical defibrillation will result in return of spontaneous circulation.

A component capable of providing electrical defibrillation without stopping chest compression or constriction, and at a specific time in the chest compression or constriction cycle.

A particular refinement to improve the efficacy of the system would be enclosure of the pneumatic bladder or bladders within a three sided gantry. The bladder or bladders can incorporate an accordion like mechanism such that the volume has significant capacity to expand. The sidewalls of the gantry would be adjusted to minimize the open space between the gantry and the patient's chest. A practitioner with ordinary skill wound know that the volume and stiffness of the pneumatic bladder, characteristics of the accordion sides and the degree of friction between the sides of the bladder and the adjustable sides of the gantry 5 would determine the force and speed of the circumferential constriction mechanism.

An additional particular refinement would be integration of the anteroposterior compression-decompression piston 3 and the gantry portions 7 of the circumferential constriction mechanism. This integration may be within the gantry structure.

The construction of the attachment capability of active decompression mechanism may be by means of a flexible diaphragm 4 within a hardened hemisphere or bell-like structure 3. This would allow it to be a component of, and functionally contribute to, both the active decompression and the circumferential constriction mechanisms. Application of negative pressure above the diaphragm would engage the attachment-adhesive capability for active decompression. Application of positive pressure above the diaphragm would engage additional compression to the mid-anterior chest, contributing to anteroposterior compression.

In various embodiments, it should be clear that:

1. Certain embodiments can include a combination of circumferential constriction and anteroposterior compression of the chest, with or without active decompression of the chest. And that the efficacy of the method may be further enhanced by providing full or partial obstruction 14 of the airway during a fixed portion of the chest compression cycle.
2. In certain embodiments, the component performing anteroposterior compression of the chest is attached to the component providing circumferential constriction.
3. In certain embodiments, the mechanism providing force to the circumferential constricting band may be altered and adjusted such that the force is applied unevenly with respect to the chest. Portions of the chest whose constriction is associated with greater positive impact on blood flow would receive greater force and constriction. In specific embodiments this can be achieved by an independent mechanism between the band and the patient.
4. In certain embodiments, the circumferential constriction and anteroposterior compression of the chest are in a fixed phasic relationship with indicators of residual cardiac mechanical or electrical activity.
5. In certain embodiments, the on-off sequence of circumferential constriction and anteroposterior compression may be adjusted to additionally improve efficacy. In one embodiment the circumferential constriction occurs before the anteroposterior compression while in another the reverse occurs.
6. In certain embodiments, the efficacy of circumferential constriction and anteroposterior compression of the chest are augmented by administration of pressor drugs.
7. In certain embodiments, the efficacy of circumferential constriction and anteroposterior compression of the chest are augmented by simultaneous or phasic abdominal binding or abdominal compression.
8. In certain embodiments, the mechanical or pneumatic force for circumferential constriction or anteroposterior compression of the chest may be provided by electrical, mechanical or pneumatic subsystems alone or in combination.
9. In certain embodiments, the circumferential constriction is provided by a band that has inflatable pneumatic chambers on all, or portion, of its inner circumference.
10. In certain embodiments, a portion of the circumferential constriction mechanism is applied to the backboard. Portions of the pneumatic bladder between the backboard and the patient may inflate simultaneously with the anteroposterior compression piston mechanism so as to enhance its efficacy.
11. In certain embodiments, a portion of the circumferential constriction is provided by inflation of pneumatic chambers applied to adjustable vertical side posts 16 connected to the backboard on either side of the patient. These may inflate before the anteroposterior compression is initiated so as to stabilize the chest.
12. In certain embodiments, the component providing anteroposterior compression of the chest also provides force to the anterior portion of a circumferential band.
13. In certain embodiments, the system includes a component capable of sensing a biomarker indicative of system efficacy. Said biomarker may control the on-off sequencing of the other mechanisms.
14. In certain embodiments, the efficacy of the system is augmented by use of a feedback mechanism to control the timing and force of the circumferential constriction and anteroposterior compression of the chest.
15. In certain embodiments, the anteroposterior compression or circumferential constriction mechanism are adjustable in shape or configuration such that they match the shape of the chest more accurately.
16. In certain embodiments, the efficacy of the system is augmented by use of a feedback mechanism that adjusts the location or vector of the anteroposterior compressive mechanism.
17. In certain embodiments, the mechanism providing anteroposterior compression applies greater force and displacement to the compression of the mid-anterior chest compared to the force and distance applied to the remainder of the chest by the circumferential constriction mechanism.
18. In certain embodiments, the system includes a component capable of providing electrical defibrillation without stopping chest compression or constriction. The positive and negative leads for this component may be applied to the patient side of the piston or circumferential constriction band. Multiple leads allows simultaneous defibrillation in multiple vectors.

19. In certain embodiments, the system includes a component capable of providing electrical defibrillation at a specific time in the chest compression or constriction cycle.
20. In certain embodiments, the system includes a component capable of varying the force or timing of chest compression or constriction so as to increase the likelihood that electrical defibrillation will result in return of spontaneous circulation.
21. In certain embodiments, the system includes a hinged backboard capable of changing the geometric relationship or relationships between the head, chest, abdomen and extremities.
22. In certain embodiments, the system includes adjustable lateral struts on either side of the patient's chest, each with a section of the circumferential pneumatic constrictor between the strut and the patient's lateral chest. This is moldable as to shape and adjustable as to location.
23. In certain embodiments, the mechanism providing anteroposterior compression is attached to a gantry over the patient. Said gantry opens such that the patient may be placed on the backboard. Closing the gantry also applies, and mechanically engages, the circumferential constriction mechanism.
24. In certain embodiments, the pneumatic bladder or bladders are enclosed within a hollow three sided gantry. The bladder or bladders are within the gantry and are accordion-like mechanism such that the volume has significant capacity to expand and compress the patient's chest. The sidewalls of the gantry would be adjustable so as to minimize the open space between their ends and the patient's chest.
25. In certain embodiments, the anteroposterior compression-decompression piston and the gantry portions of the circumferential constriction mechanism are integrated within the gantry.
26. In certain embodiments, there are force sensors applied to the patient side surfaces of the anteroposterior compression-decompression piston and the circumferential constriction mechanism. Signals from these sensors are used to adjust the force of the mechanisms.
27. In certain embodiments, the attachment capability of the active decompression mechanism is achieved by means of a flexible diaphragm within a hardened hemispheric structure. Application of negative pressure above the diaphragm would engage the attachment capability for active decompression. Application of positive pressure above the diaphragm would create additional compression to the mid-anterior chest.
28. In certain embodiments, there is an additional mechanism for phasic compression 15 of the abdomen.
29. In certain embodiments, the structure holding the anteroposterior compression mechanism can be moved with respect to the patient's chest such that the location and vector of force is changed.
30. In certain embodiments, an additional component may provide electrical defibrillation at a specific and optimal time in the chest compression constriction cycle without stopping chest compression or constriction.
31. In certain embodiments, the mechanism providing anteroposterior compression applies greater force and distance to the compression of the mid-anterior chest compared to the force and distance applied to the remainder of the chest circumference by the circumferential constriction mechanism.
32. In certain embodiments, the anteroposterior compression or circumferential constriction mechanism are adjustable in shape or configuration such that they match the shape of the chest more accurately.
33. In certain embodiments, the anteroposterior compression-decompression piston and the gantry portions of the circumferential constriction mechanism are integrated within the gantry.
34. In certain embodiments, the circumferential constriction mechanism is a belt. Said belt is attached at one end to the side of the anteroposterior compression mechanism and at the other end to motors on either side of the patient and incorporated in the backboard.

Similar to spontaneous circulation, forward blood flow in the arterial circulation during CPR is limited to the volume of blood returning to the central circulation via the venous vasculature. During CPR, enhanced venous return can improve cardiac output and overall forward blood flow. Enhanced venous return can mean more blood is returned to the heart from the body, and the additional blood returned to the heart can result in more blood being available for cardiac output, thereby improving cardiac output during CPR. In various embodiments, mechanical CPR can include a piston that can provide compression to the chest for cardiac output. In various embodiments, mechanical CPR can be achieved by circumferential constriction using a pneumatic bladder vast or belt. In various embodiments, sternal compression CPR can be combined with circumferential constriction CPR.

During application of mechanical sternal compression CPR, provision of active sternal decompression can enhance venous return and cardiac output. Such active decompression can include attachment of the piston device to the chest. In various embodiments this can be achieved by use of a suction cup or other suction device at the end of the piston. Retraction of the piston that has been secured to the chest can result in active decompression of the chest by pulling up on the chest in between chest compressions.

Circumferential constriction CPR can include compressive force being applied during CPR through constriction of the patient's chest. This circumferential constriction CPR can be more effective than standard sternal compression at generating forward blood flow. In various embodiments, circumferential constriction CPR can be provided by Vest CPR, where a bladder-containing garment (similar to a large blood pressure cuff) can be placed around the chest, and the vest can be cyclically inflated by a pneumatic drive system. In various embodiments, circumferential constriction CPR can also be provided by Belt CPR, wherein a belt is placed around the thorax with the belt's circumference cyclically decreased and released. Improved venous return from active decompression of the chest can also enhance the efficacy of circumferential constriction CPR. However, the current versions of Vest- and/or Belt-CPR do not provide for enhanced venous return by application of active thoracic decompression.

Figure 3:
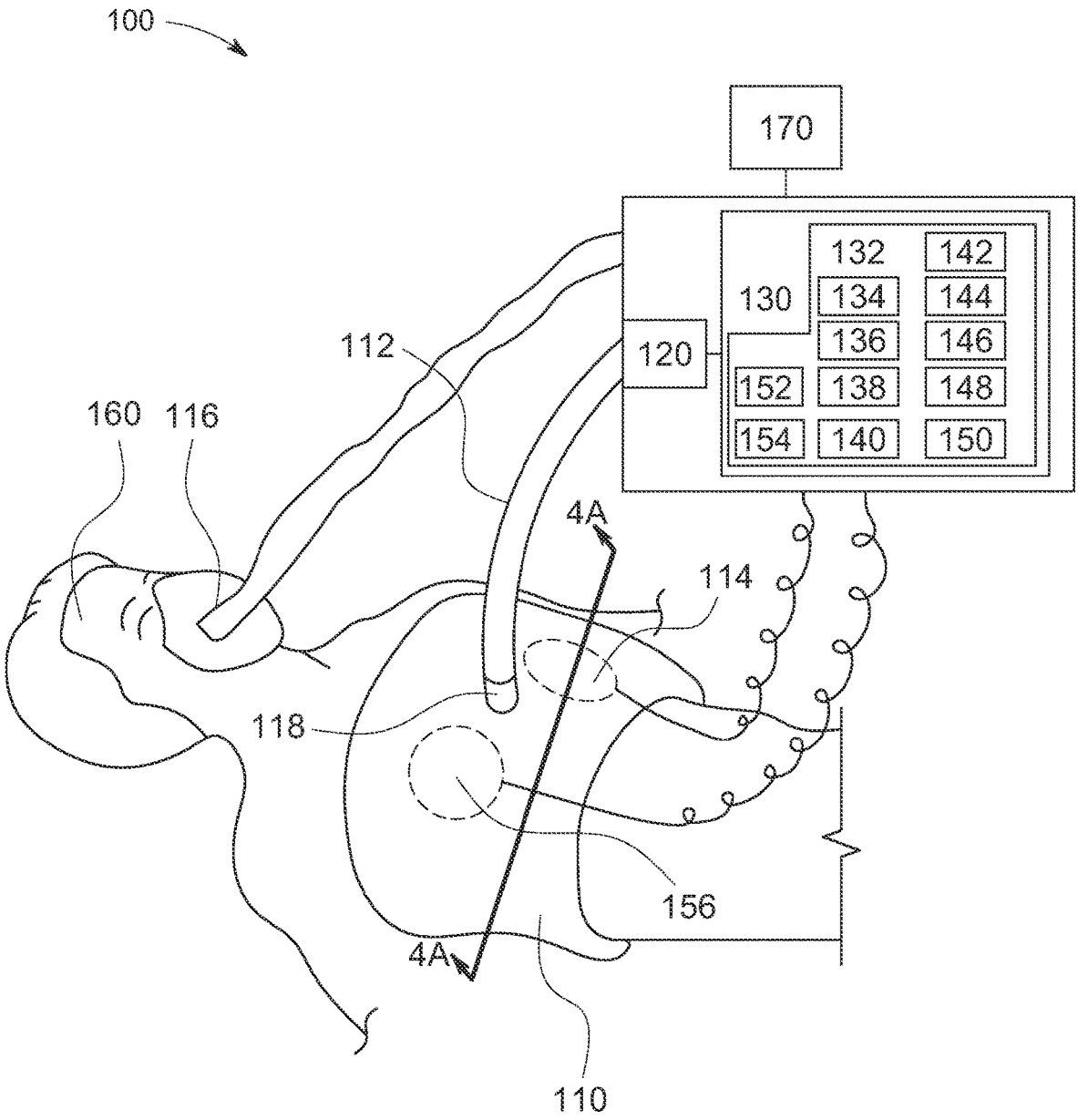
FIG. 3 is a schematic diagram of a circumferential constriction CPR system, according to an illustrative embodiment.

FIG. 3 is a schematic diagram of a circumferential constriction CPR system, according to an illustrative embodiment. A circumferential constriction CPR system 100 can include a vest 110 that contains at least one air bladder within the vest. The circumferential constriction CPR system 100 can have a pneumatic drive unit 120 that can forcefully inflate the bladder with a fluid such as air. Although the circumferential constriction CPR system 100 described herein is described as using a gas such as air as the fluid in a pneumatic system, it should be clear that other fluids are specifically contemplated, including: noble gases, and hydraulic systems that can operate with water, oil, or other fluids, and in various embodiments the described pneumatic system can be a hydraulic system.

The pneumatic drive unit 120 can rapidly inflate and deflate the one or more bladders in the vest 110 by forcing air in and out of the vest through the tube 112. The vest can be inflated and deflated to provide mechanical CPR according to the guidelines for CPR as promulgated by the American Heart Association, or alternative rates optimized to the type of CPR or adaptively based on closed-loop control. Constant with the American Heart guidelines, the vest can be inflated and deflated in a range of approximately 60 to 130 cycles per minute. Specifically, the vest can be inflated and deflated approximately 100 cycles per minute. The vest can be forcefully and quickly inflated for each constriction cycle, and forcefully and quickly deflated after each constriction. The CPR system 100 can include an inflation/deflation valve 118 that can be switched between inflating and deflating the vest 110.

The circumferential constriction CPR system 100 can include an airway occluder 116. The airway occluder 116 can be controlled to occlude the patient's airway during active vest deflation, further enhancing negative intrathoracic pressure and venous return. Additional enhancement of negative intrathoracic pressure and venous return can be achieved during standard sternal compression CPR by briefly obstructing the airway during the decompression release phase. This can be achieved through utilization of an occluder that can be a cracking valve mechanism called an impedance threshold device. Occlusion of the patient airway and the active decompression of the chest can be synchronized, so as to increase the degree of negative intrathoracic pressure and venous return.

The circumferential constriction CPR system 100 can include one or more sensors 114 that can be located on a patient facing inner side of the vest 110. Sensors 114 can include an electrocardiogram, an accelerometer, a force transducer, ET-CO2 sensor, SPO2 sensor, impedance sensor, and/or an acoustical microphone. One or more sensors 114 can be located in different positions around the patient 160. Sensed data, also referred to as biological feedback, can be received by a controller 130 of the CPR system. The controller 130 can automatically adjust various parameters in response to the sensed data, including adjusting the force of the constrictions, the speed of constrictions, the distance of constrictions/amount of fluid moved during each cycle, the frequency of constrictions, the length of compression phases in each cycle, the force of active deflation, the length of decompression phases in each cycle, the length of relaxation phases in each cycle, and/or airway occlusion during decompression. The controller 130 can adjust parameters by controlling the operation of the drive unit 120. The controller includes a processor 132, and processor 132 can have a force control module 134, a speed control module 136, a fluid volume control module 138, a phase frequency control module 140, a compression phase timing module 142, a relaxation phase timing module 144, a decompression phase timing module 146, airway occlusion control module 148, an inflation/deflation valve control module 150 and/or a monitoring module 152. The monitoring module 150 can monitor the one or more sensors so that the control module can automatically adjust the parameters in response to the sensed data. The controller 130 can be operatively connected to user interface 170 that can include a keyboard and/or touchscreen.

The CPR system 100 can include defibrillation electrodes 156 in the vest 110. The defibrillation electrodes 156 can be gel defibrillation electrodes, and the gel defibrillation electrodes can be incorporated into the adhesive on the patient facing surface of the vest. Defibrillation timing can be coordinated with the CPR cycles of inflation and deflation. The defibrillation can be controlled by a defibrillation control module 154.

Figure 4A:
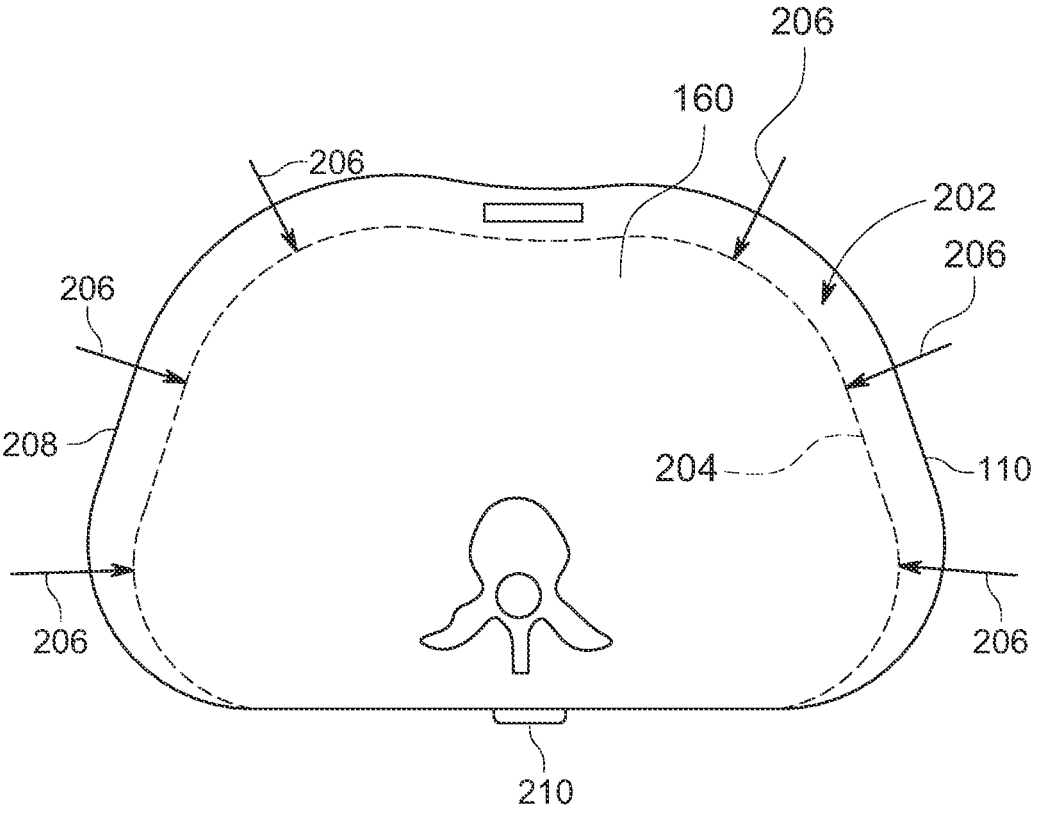
FIG. 4A is a cross section of the patient and circumferential constriction CPR system of FIG. 3, taken along cross section line 4A-4A of FIG. 3, according to an illustrative embodiment.

FIG. 4A is a cross section of the patient and circumferential constriction CPR system of FIG. 3, taken along cross section line 4A-4A of FIG. 3, according to an illustrative embodiment. Vest 110 includes at least one bladder 202 that can be filled with a fluid, such as air, by the pneumatic drive unit. The bladder can have a non-distendable outer circumference 208. Filling the bladder 202 with fluid causes the inner surface of the vest to constrict around the patient 160 resulting in cardiac output. As the bladder 202 fills with fluid, an inner surface of the vest 204 pushes against the patient 160 with a force vector along arrows 206. Vest 110 can have a seam 210 that can be opened and closed so that the vest can be secured around the patient in a manner similar to a blood pressure cuff. The seam 210 can include Velcro or other means for securing the vest around the patient. In vest circumferential constriction CPR mechanisms, a pneumatic drive unit can provide positive pressure gas for inflation.

In various embodiments, a circumferential constriction member, such as vest 110, can be anchored to the inside of a structural support member, such as a cuirass. The cuirass can provide a rigid supporting structure, so that active deflation of the vest can result in a centrifugal pulling force on the patient. Anchoring the outer surface of the vest to a rigid structure such as a cuirass allows the inner surface of the vest to pull outward on the patient when the one or more bladders in the vest are forcefully deflated. Use of a cuirass to provide a rigid structure in front of or around the torso can augment the effectiveness of forceful deflation and decompression to achieve increased negative intrathoracic pressure. In various embodiments, the structural cuirass may include an inflatable bladder that can be filled to rigidity under pneumatic pressure to form a rigid support structure. Such a pneumatic bladder cuirass may be inflated from the same pneumatic drive system that actively inflates and actively deflates the circumferential constriction CPR vest. Placement of one way valve between the circumferential constriction CPR pneumatic system and the pneumatic bladder cuirass would act to automate inflation of the pneumatic bladder cuirass at the start of CPR.

Figure 4B:
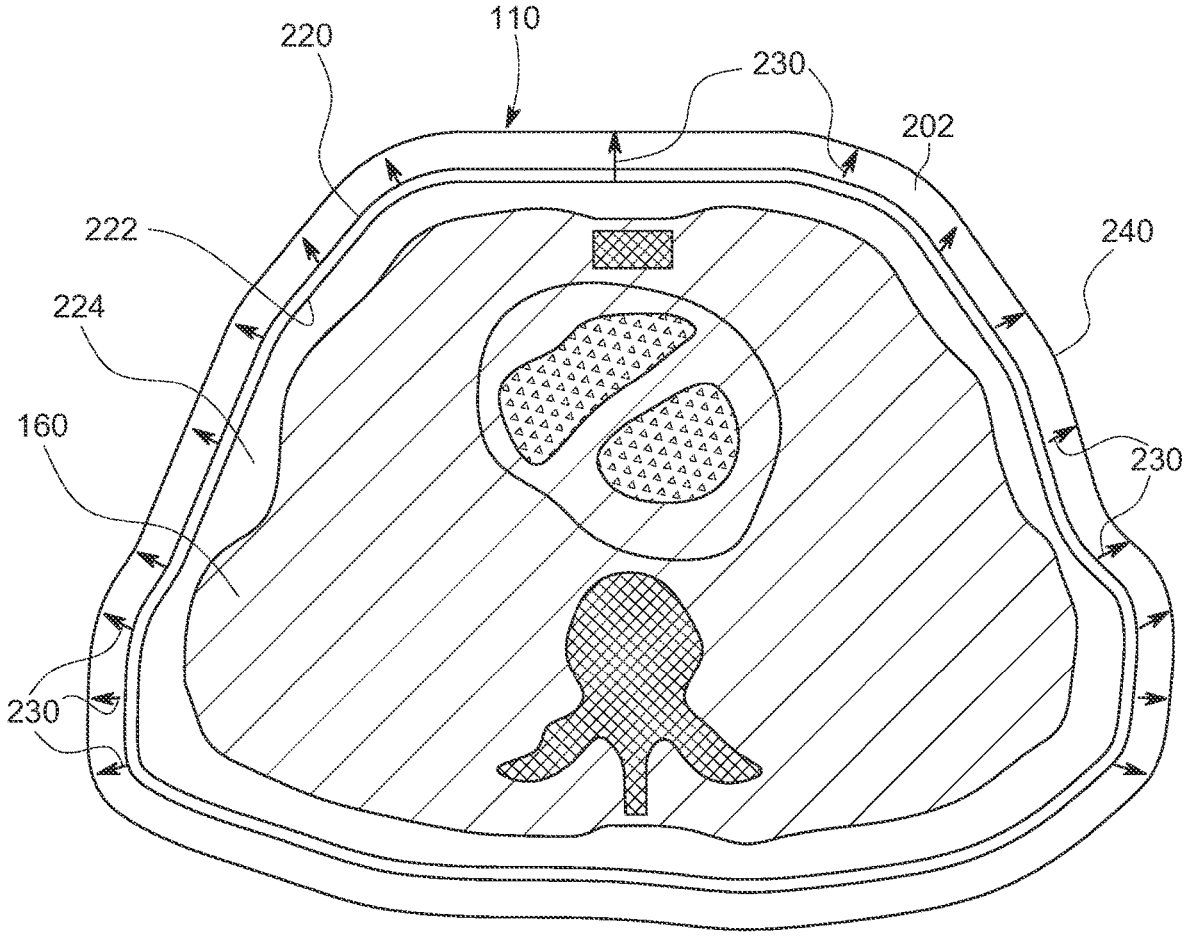
FIG. 4B is a cross section of the patient with active decompression applied to the torso, according to an illustrative embodiment.

FIG. 4B is a cross section of the patient with active decompression applied to the torso, according to an illustrative embodiment. The inner, patient-facing surface 220 of the vest 110 can be in direct contact with the patient 160. In various embodiments, the patient-facing surface 220 of the vest can include an adhesive 222 that can adhere the vest to the patient. In various embodiments, the inner surface of the vest can have a layer of hydrogel 224, or other liquid, that can increase the adhesion of the inner surface 220 to the patient 160 through surface tension. In various embodiments, the active deflation may create vacuum between the vest and the skin, and this will enhance the active thoracic decompression.

The circumferential constriction CPR system can include active decompression that can be provided through rapid deflation of the bladder 202 by the pneumatic drive unit. The pneumatic drive system, and the inflation-deflation tubes and valves are capable of active deflation of the vest by application of: 1) an actual or relative vacuum pressure, 2) a pressure lower than atmospheric to the bladder, 3) a pressure less than the pressure within the bladder. Such application of relative vacuum will act to deflate the bladder more rapidly than would occur through passive abatement of the inflating positive pressure. As the bladder 202 is rapidly deflated by the pneumatic drive unit, an outward force can be exerted on the patient along force vector arrows 230, as the patient facing surface 220 of the vest is pulled outwards towards a supporting structure, or cuirass 240 in front of or around the exterior of the vest. The exterior of the bladder 202 can be maintained in a set shape by the cuirass 240, so that deflating the bladder can pull the patient facing surface 220 towards the cuirass 240 and away from the patient 160. Put another way, the patient facing surface 220 can pull outwards on the patient along force vectors 230 when the bladder is deflated by the pneumatic drive unit. Pulling outwards on the patient can provide active decompression to the patient which can increase venous return. The patient facing surface 220 can pull outwards on the patient through an adhesive function that can be provided by one or more of adhesive, surface tension, and/or a partial vacuum that can be created between the patient facing surface 220 and the patient 160 as the bladder is deflated.

In various embodiments, the cuirass may be made from materials that are intrinsically resilient and/or elastic. The cuirass can be deformed by compression, and then can apply an active decompressive force as the cuirass springs back toward the native shape. In this manner, the energy cost of active decompression may be lessened, as the resilient or springy cuirass gives energy back after each active compression. In various embodiments, the curved shape of the cuirass with the convex interior can add additional springiness to the cuirass as it springs back toward the native shape. In a resting state, the cuirass can have a shape that curves away from the center of the patient's chest.

Figure 4C:
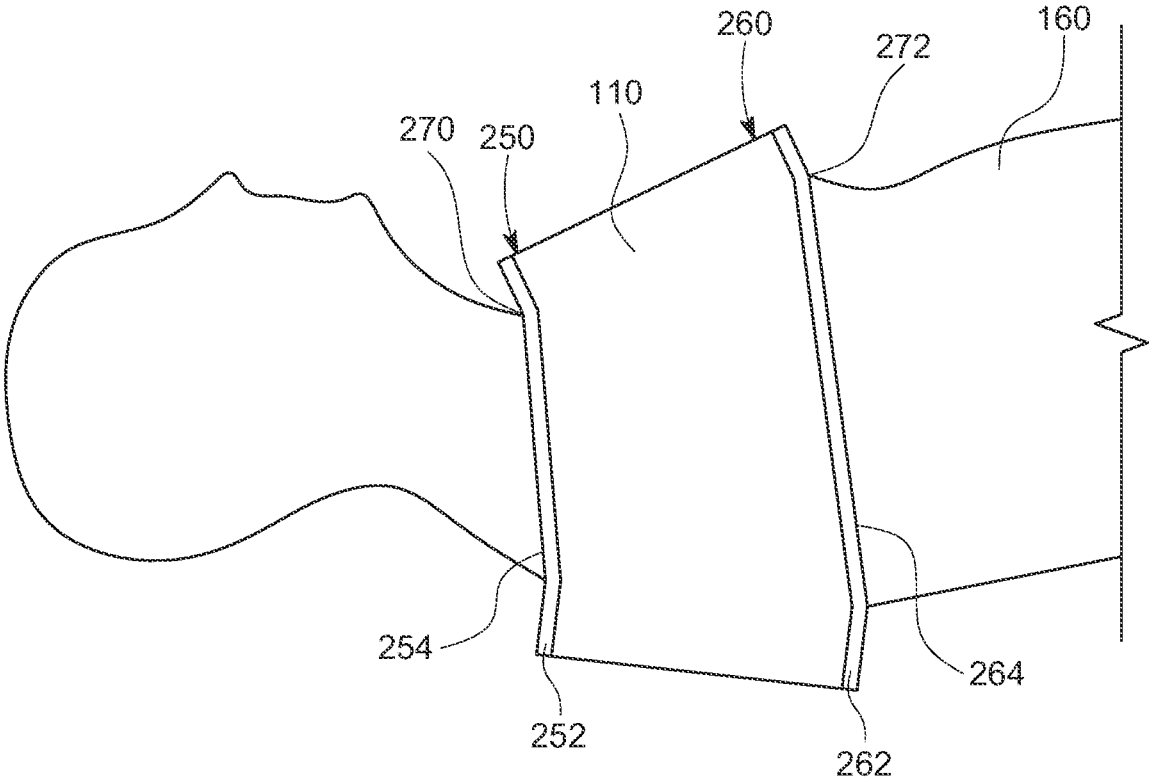
FIG. 4C is a side view of the patient with a circumferential constriction vest on the patient's torso, according to an illustrative embodiment.

FIG. 4C is a side view of the patient with a circumferential constriction vest on the patient's torso, according to an illustrative embodiment. In various embodiments, the vest can include a cuff, constriction, or other seal or partial seal at the upper end and the lower end of the vest to limit the flow of air into any space between the patient and the patient-facing surface. In various embodiments, the vest can be wrapped around the patient, and can extend approximately from the sternal notch cephalad 270 to the xiphoid process caudad 272. The vest 110 can have an upper seal 250 that can secure the vest around the patient 160 approximately at the level of the sternal notch cephalad, and the upper seal 250 can encircle the patient so that air is prevented from entering into any space between the patient and the patient facing surface of the vest. The upper seal can include an inflatable cuff 252 and/or an adhesive 254. The vest can have a lower seal 260 that can secure the vest around the patient approximately at the level of the xiphoid process caudad 272 or lower costal margin, and the lower seal 260 can encircle the patient so that air is prevented from entering into any space between the patient and the patient facing surface of the vest. The lower seal 260 can include an inflatable cuff 262 and/or an adhesive 264. The upper seal and lower seal can help the vest to remain secured to the patient, and/or can help the vest to provide a negative extrathoracic pressure as the vest is deflated, so that the vest pulls outward on the thorax during active decompression. As the vest pulls outwards on the thorax during active decompression, the vest can create a negative intrathoracic pressure.

Active decompression can provide improved venous return by increasing negative intrathoracic pressure and helping to pull blood back to the heart or chest from the peripheral venous system. Active decompression in the form of outward force applied to the chest to expand the thorax during CPR decompression can enhance venous return. The larger the region of the thorax with active forceful decompression, the greater the enhancement in venous return. Including active forceful decompression over the area of the circumferential constriction can provide better venous return than active decompression that is limited to the area of piston contact with the patient's sternum in piston-based mechanical CPR. Pulling outwards on the patient's torso by the circumferential constriction member in between constrictions can provide the active decompression to increase venous return. In some embodiments, the enhanced negative intrathoracic pressure created by active decompression of the chest via active deflation of a circumferential vest will be greater than what has been achieved by active sternal decompression via a local piston mechanism.

Both of these types of circumferential constriction CPR, belt and/or vest, can benefit from a structural member that can allow the constriction device to provide outward force. A cuirass can be a rigid form that can provide structure around the torso. In various embodiments, the cuirass structural capability may be created by inflating a pneumatic bladder exterior to the circumferential constriction vest to a pressure sufficient to achieve structural rigidity. In various embodiments, a cuirass can encircle the torso of the patient so that the front of the cuirass can be held in position above the torso and can provide an anchoring point to the deflating vest so that the deflating vest can pull outward on the torso. In various embodiments, a partial cuirass can be positioned above the torso as an anchoring point for the deflating vest, and the partial cuirass can be held in place by various supports that can rest on the ground, or can be anchored to a backboard, or other means to support the cuirass in place.

The efficacy of CPR may be enhanced by adapting the force or timing of the compressions or decompressions by means of closed-loop feedback mechanisms based on biomarkers of perfusion that have been collected by the one or more sensors and provided to the controller. The efficacy of CPR may be enhanced by adapting the synchronization patterns of compressions, decompressions, and/or ventilations by means of closed-loop feedback mechanisms based on biomarkers of perfusion that have been collected by the one or more sensors and provided to the controller. The ventilation patterns can be altered in phase with the active decompression of the thorax. Said biomarkers may be derived from the electrocardiogram (ECG), End-tidal CO2 (ET-CO2), near infra-red spectroscopy based measurements of tissue oxygen or plethysmography, or impedance, among others. The controller can adapt the parameters of the compression and/or decompression based on the biomarker feedback in order to optimize the performance of the CPR, as measured by the one or more biomarkers of perfusion. In automated CPR, the forces may be derived mechanically or pneumatically, and the controller can adapt the forces to optimize the performance of the CPR system.

Figure 5:
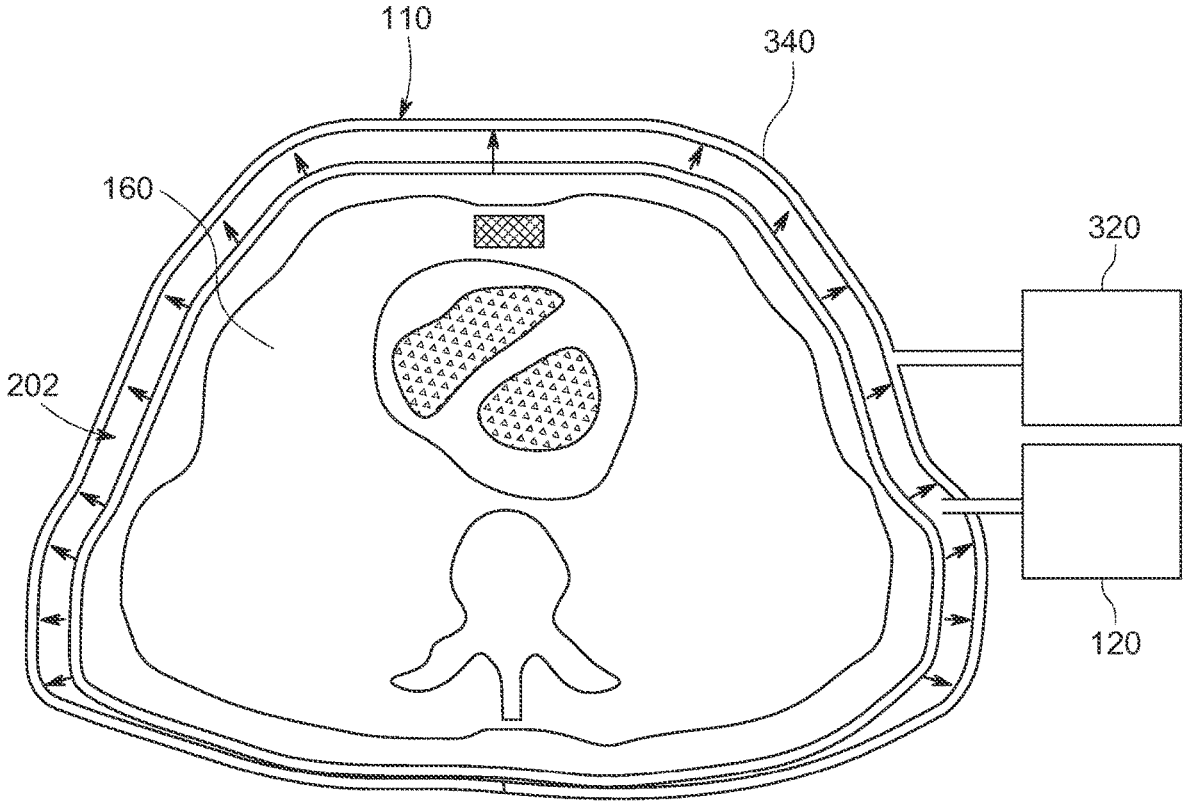
FIG. 5 is a cross section of the patient with a pneumatic cuirass, according to an illustrative embodiment.

FIG. 5 is a cross section of the patient with a pneumatic cuirass, according to an illustrative embodiment. A circumferential constriction CPR system can include various types of cuirass so that the bladder 202 can be supported in pulling outward on the patient. As shown in FIG. 5, the cuirass can be an inflatable cuirass 340 that can be inflated to create a rigid shape after the vest 110 with the cuirass 340 has been wrapped around the patient 160. In various embodiments, the circumferential constriction CPR system can include a pneumatic drive system 120 for the bladder 202, and the circumferential constriction CPR system can include a pneumatic drive system 320 for the inflatable cuirass 340. In various embodiments, the pneumatic drive system 120 and the pneumatic drive system 320 can be different systems, or can be the same system. The pneumatic drive system 320 for the inflatable cuirass 340 can maintain the inflatable cuirass 340 in a fully-inflated and rigid conformation throughout the application of CPR. While the inflatable cuirass 340 remains rigid around the patient, the bladder 202 can be rapidly inflated and deflated to provide circumferential constriction and circumferential decompression CPR.

Figure 6A:
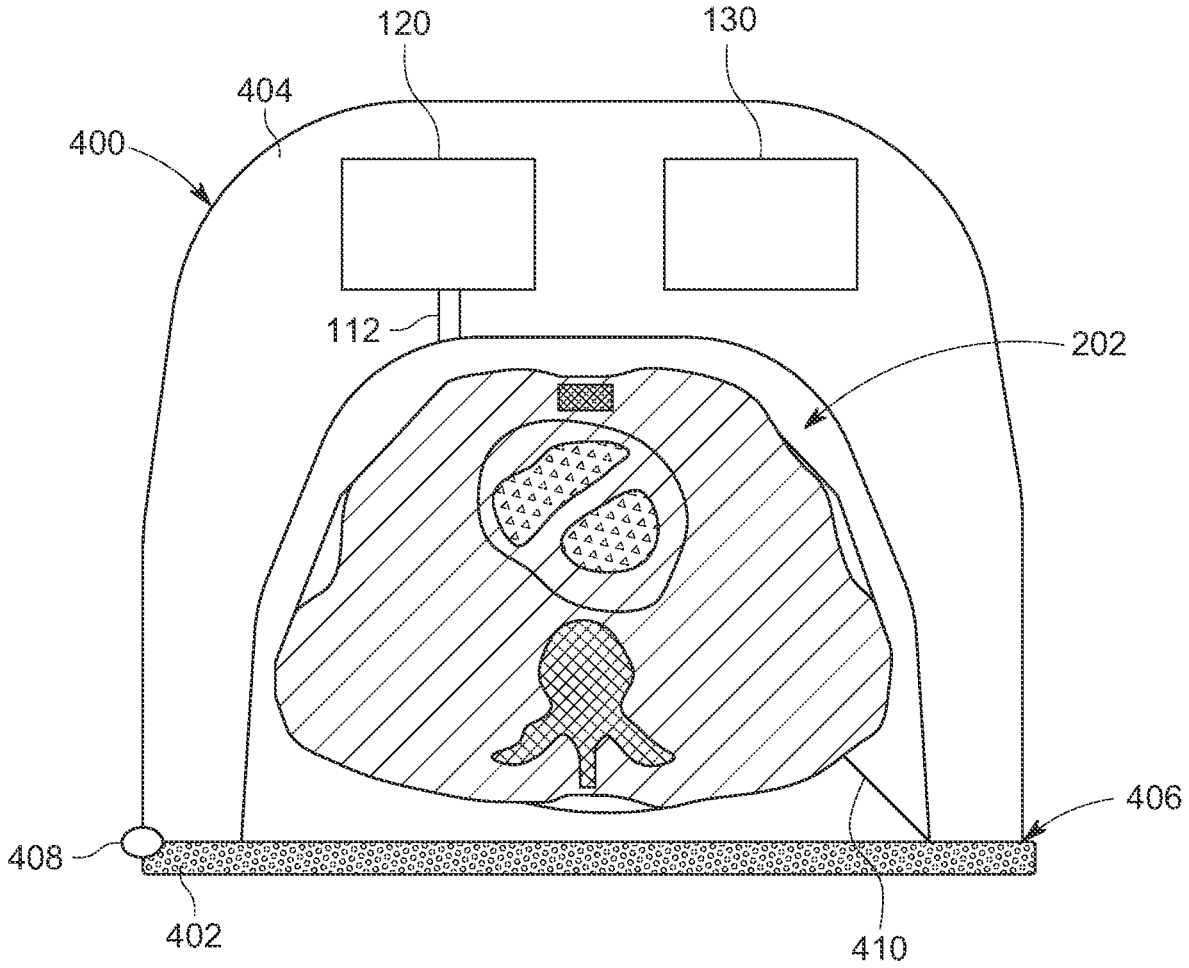
FIG. 6A is a cross section of the patient with a hard shell cuirass, according to an illustrative embodiment.

FIG. 6A is a cross section of the patient with a hard shell cuirass, according to an illustrative embodiment. In various embodiments, a cuirass can be a hardshell cuirass with a frame 400. The frame 400 can include a backboard 402 and an upper shell 404. The hardshell cuirass can have an opening 406 at one side and a hinge 408 so that the cuirass can be closed around the patient. The bladder 202 can be inflated so that inner, patient facing surface of the bladder can be in contact with the patient. The bladder 202 can have a seam 410 so that the bladder can be opened for the insertion of the patient, and the bladder can be closed around the patient by closing the hardshell cuirass after the patient is in place. The pneumatic drive unit 120 can then inflate and deflate the bladder to provide forceful constriction and forceful decompression to the patient. In various embodiments the pneumatic drive unit 120 and/or the controller 130 can be integrated into the hardshell cuirass or can be part of a removable unit that can be connected to the vest through various connections such as hoses and wires.

Figure 6B:
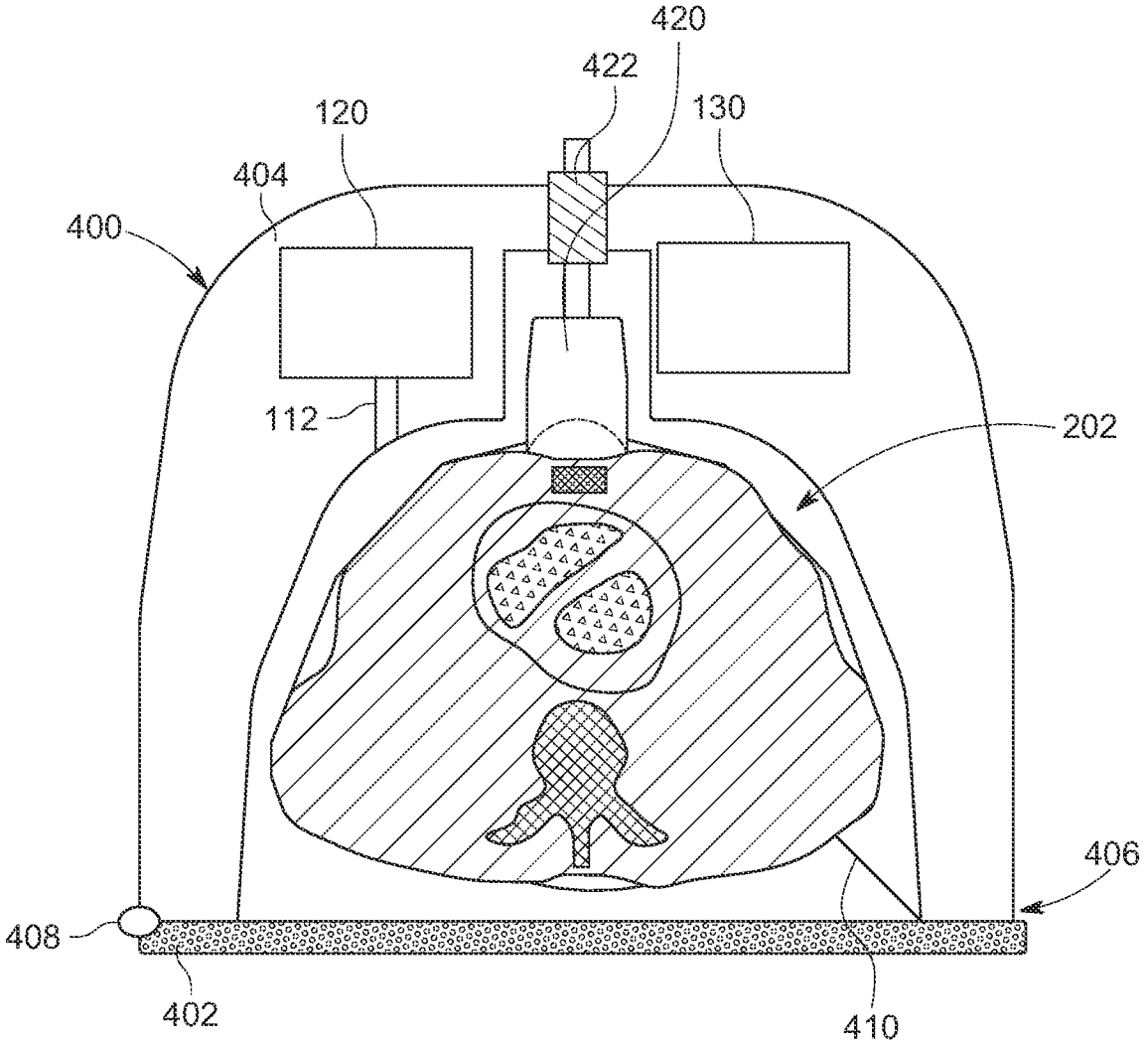
FIG. 6B is a cross section of the patient with a hard shell cuirass that includes a mechanical piston, according to an illustrative embodiment.

FIG. 6B is a cross section of the patient with a hard shell cuirass that includes a mechanical piston, according to an illustrative embodiment. In various embodiments, a mechanical piston 420 can provide active compression to the patient. In various embodiments, the mechanical piston can provide active decompression to the patient. The mechanical piston can be used in addition to the circumferential vest. The inflation and deflation of the vest, and the compression and decompression of the piston can be synchronized by the controller, and can be simultaneous or can occur at various phasic times throughout the CPR cycle. The mechanical piston can be powered by a piston drive unit 422 that can be pneumatic, electromechanical, or other drive means.

Figure 7:
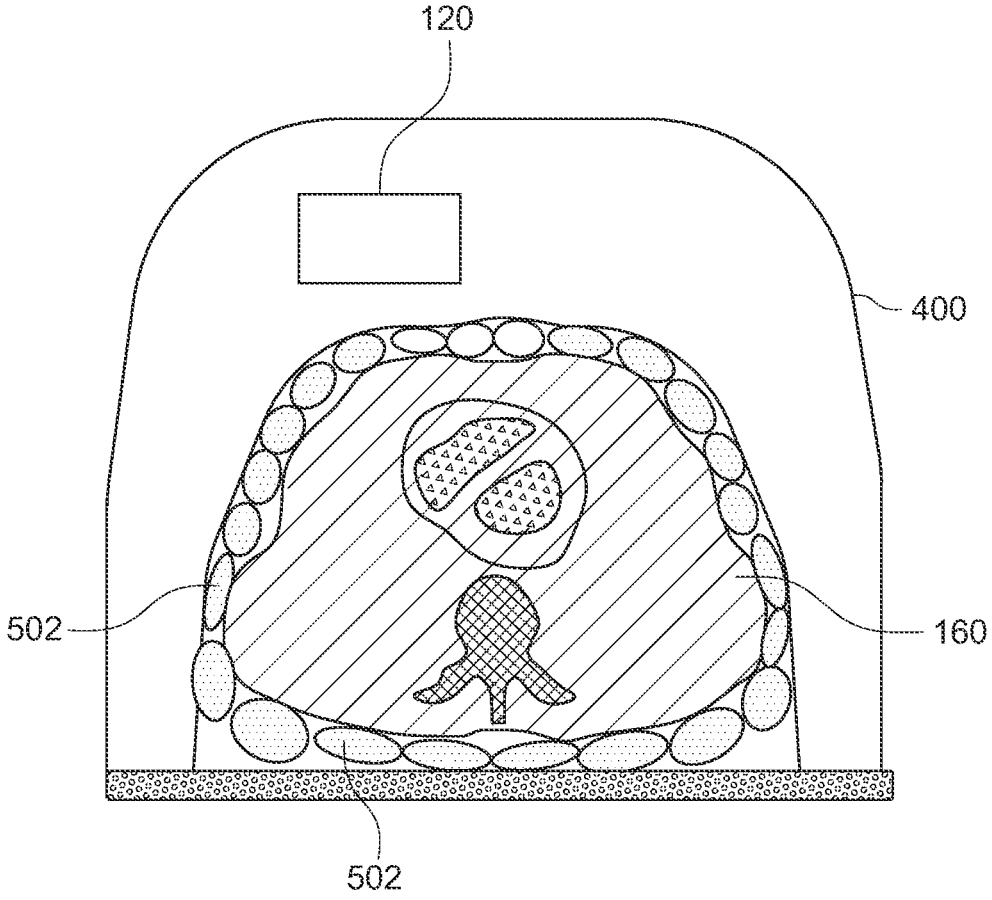
FIG. 7 is a cross section of the patient with a hard shell cuirass and a plurality of air bladders within the circumferential constriction system, according to an illustrative embodiment.

FIG. 7 is a cross section of the patient with a hard shell cuirass and a plurality of air bladders within the circumferential constriction system, according to an illustrative embodiment. In various embodiments, a circumferential constriction CPR system can have a vest with a plurality of bladder compartments 502. The plurality of air bladders 502 can be inflated and deflated by a single pneumatic drive 120 or a plurality of pneumatic drives. Various valves and control mechanisms can be used to control the inflation and deflation of the different bladders, so that various parameters such as the volume and/or speed of the inflation and deflation can be different at different locations around the patient. The pattern of active compression and/or active decompression can be non-uniform around the chest.

Figure 8:
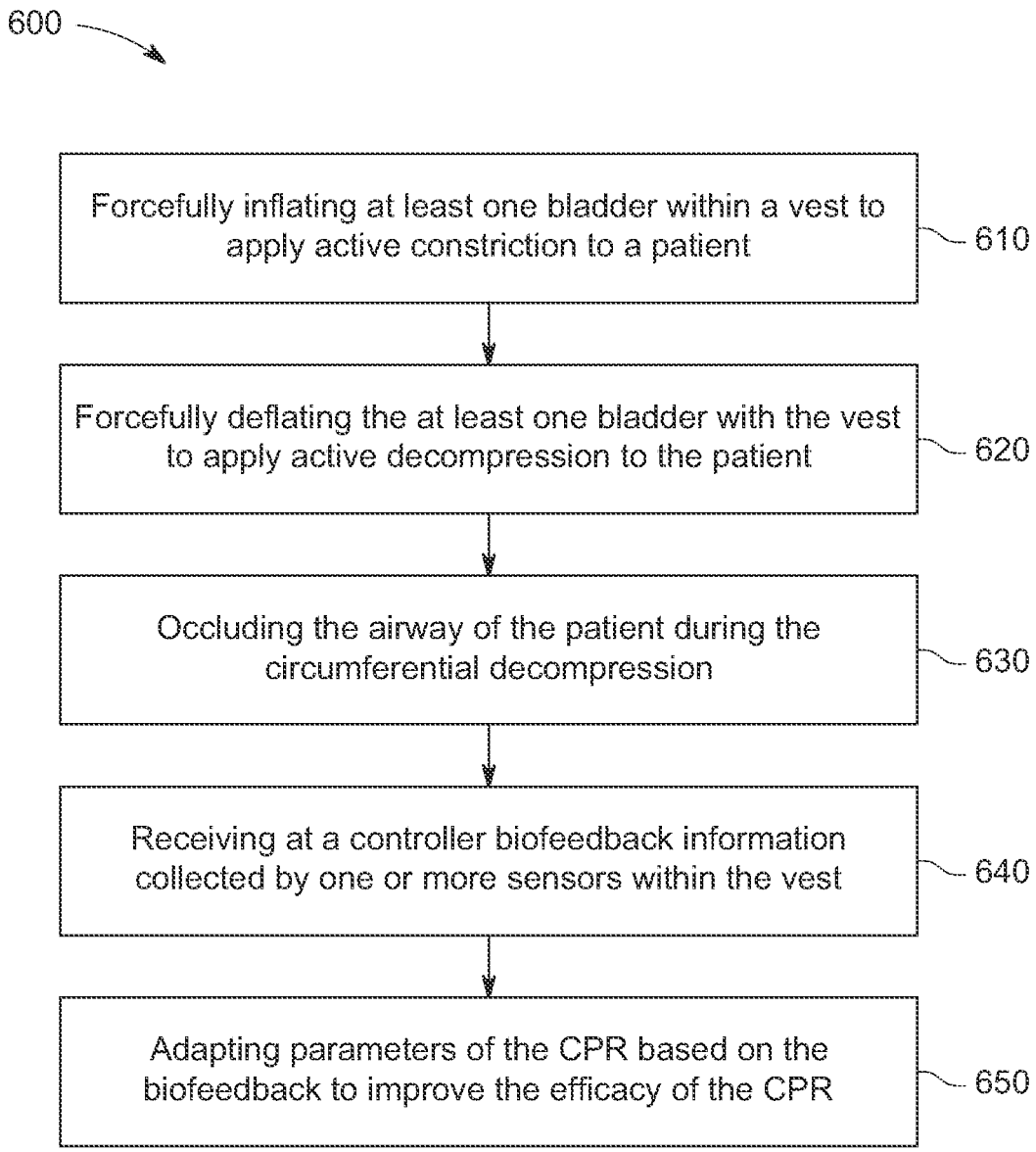
FIG. 8 is a flow chart showing a method of performing automated CPR, according to an illustrative embodiment.

FIG. 8 is a flow chart showing a method/process 600 for performing automated CPR, according to an illustrative embodiment. At step 610, the method/process 600 of performing CPR can include forcefully inflating at least one bladder within a vest to apply circumferential constriction to a patient. At step 620, the method/process 600 can include forcefully deflating the at least one bladder within the vest to apply circumferential decompression to a patient. At step 630, the method/process can include occluding the airway of the patient during the circumferential decompression. At step 640, the method/process 600 can include receiving at a controller biofeedback information collected by one or more sensors within the vest. At step 650 the method/process 600 can further include adapting parameters of the CPR based on the biofeedback to improve the efficacy of the CPR.

Figure 9A:
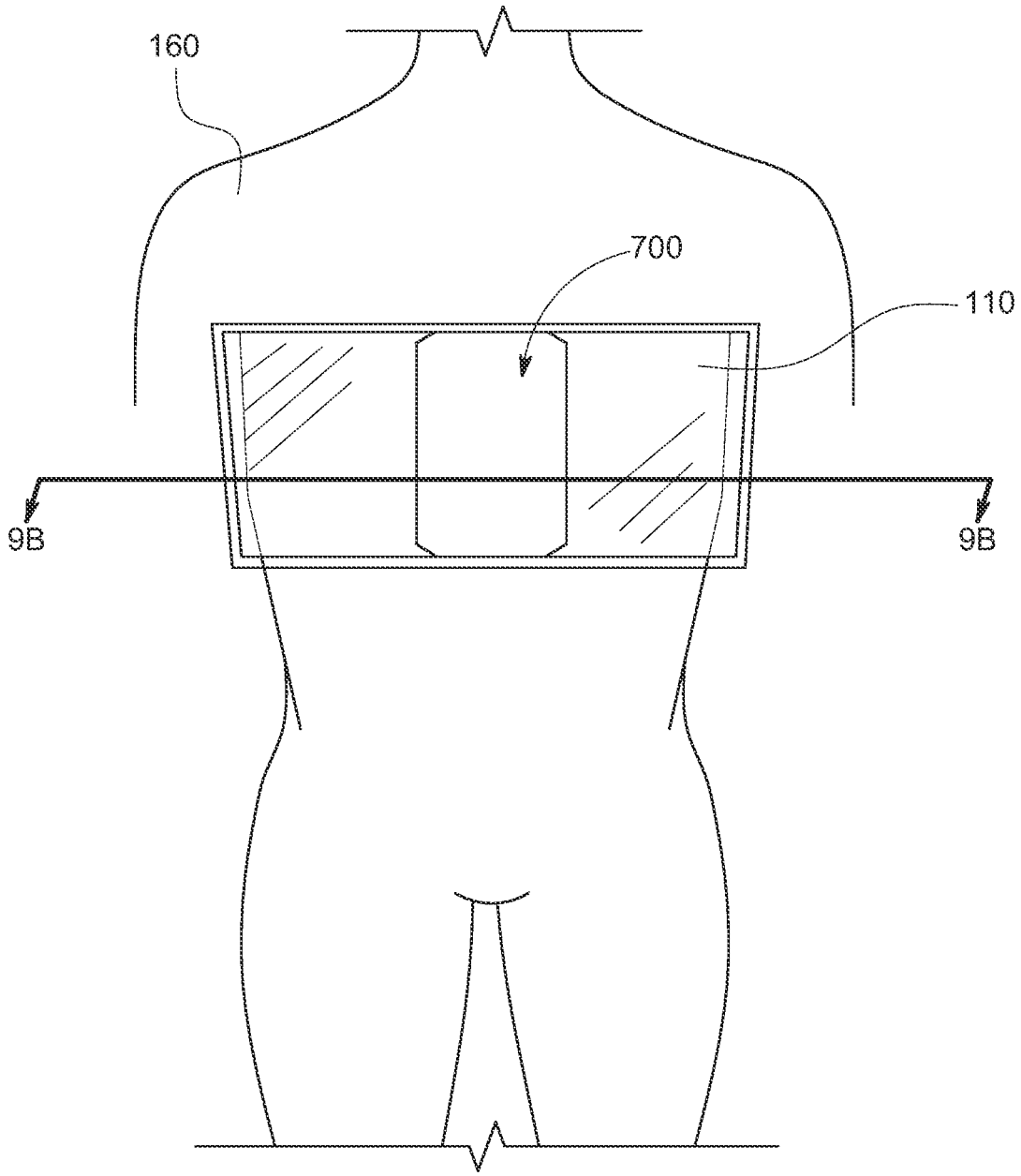
FIG. 9A is a schematic top view of a patient with a circumferential constriction CPR system having a localized sternal bladder, according to an illustrative embodiment.
Figure 9B:
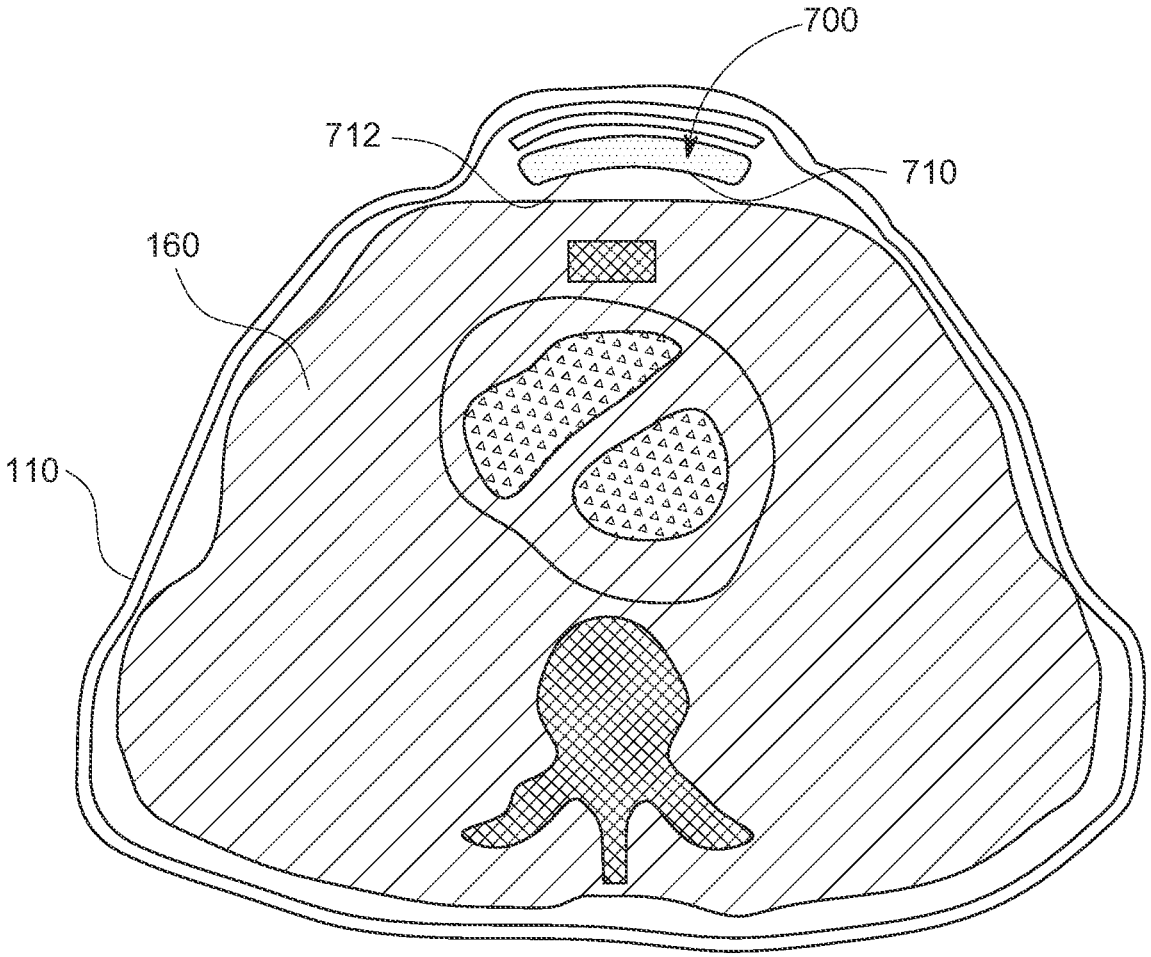
FIG. 9B is a cross section of the patient and circumferential constriction CPR system with a localized sternal bladder of FIG. 9A, taken along cross section line 9B-9B, according to an illustrative embodiment.

FIG. 9A is a schematic top view of a patient with a circumferential constriction CPR system having a localized sternal bladder, and FIG. 9B is a cross section of the patient and circumferential constriction CPR system with a localized sternal bladder of FIG. 9A, taken along cross section line 9B-9B, according to an illustrative embodiment. In various embodiments, a circumferential constriction CPR system can include an additional pneumatic sternal bladder 700 placed between the circumferential constriction vest 110 and the anterior chest of the patient 160, centered on the patient's sternum. In various embodiments, the sternal bladder can extend approximately from the sternal notch cephalad to the xiphoid process caudad. The additional sternal bladder in the region of the patient's mid-anterior chest extending top to bottom from the sternal notch cephalad to a xiphoid process caudad, and side-to-side from between the lateral edge of the sternum and the medial nipple line on each side of the patient. Although the cuirass is omitted from these figures for the purpose of clarity, it should be clear that any of the above-described cuirasses can be used to provide structure to the embodiment shown in FIG. 9A and 9B, and other embodiments described herein. The pneumatic sternal bladder 700 can be selectively activated, and active inflation of this sternal pneumatic bladder 700 can achieve active selective compression of the sternum. These active selective sternal compressions can be either simultaneous with circumferential constriction or decompression, or synchronously before or after circumferential constriction or decompression. The efficacy of the circumferential vest may be enhanced by this pneumatic sternal bladder 700 over the anterior sternum and beneath the circumferential vest 110. This pneumatic bladder may be inflated synchronously with the circumferential pneumatic vest or sequentially before or after the circumferential vest. In various embodiments, the selective sternal bladder may have its own cuirass. The sternal bladder cuirass can provide a structure that can allow the sternal bladder to provide active decompression that can be separate from the circumferential constriction vest decompression.

The sternal bladder 700 may also have active deflation as a mechanism for active decompression of the anterior thorax. Active deflation of this sternal pneumatic bladder may further achieve selective active decompression of the chest in the region of the sternum. This selective sternal decompression may be either simultaneous with circumferential decompression or synchronously before or after circumferential decompression. In various embodiments, the patient-facing surface 710 of the sternal bladder 700 can include an adhesive 712 that can adhere the sternal bladder 700 to the patient. In various embodiments, the sternal bladder can have a patient-facing surface that can be convex so that it can more closely adhere to the shape of the patient. Incorporation of selective sternal compression and/or decompression in addition to circumferential constriction may be determined adaptively based on closed-loop biological feedback. The biological feedback can be received by the controller of the CPR system, and the controller can automatically adjust the parameters such as the force, depth, and/or speed of the compressions and/or decompressions of the sternal bladder in response to the biological feedback. The controller can automatically adjust the parameters of the sternal bladder and can synchronize the action of the sternal bladder with the action of the circumferential constriction vest 110 in response to the biological feedback. In various embodiments, the synchronization of the sternal bladder and the circumferential constriction vest can be simultaneous or can have specific phasic offsets in the cycle. In a specific embodiment, circumferential constriction may occur between 50 and 200 ms before activation of the selective sternal bladder. This may act to stabilize mediastinal structures such that selective cardiac compression may be achieved.

Figure 10:
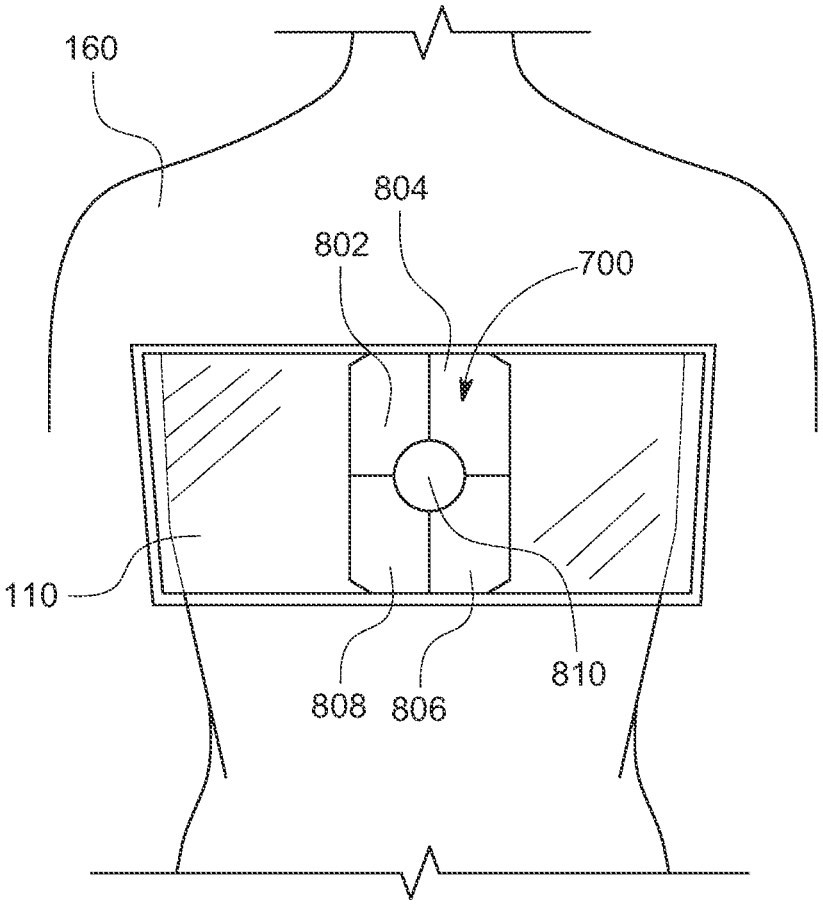
FIG. 10 is a schematic top view of a patient with a circumferential constriction CPR system having a sternal bladder with multiple sub-compartments, according to an illustrative embodiment.

FIG. 10 is a schematic top view of a patient with a circumferential constriction CPR system having a sternal bladder with multiple sub-compartments, according to an illustrative embodiment. The selective sternal bladder may be a single compartment or multiple compartments. The sternal pneumatic bladder 700 can include multiple sub-compartments 802, 804, 806, 808, 810 that may be selectively actively inflated and/or deflated so as to further focus the selective anterior chest region that is being subjected to compression and/or decompression. Multiple compartments allows selective compression of either the central sternum and/or any one or more of the four surrounding quadrants. These selective quadrant compartments may also be actively deflated to achieve localized active decompression. The sternal bladder can be segmented such that the pneumatic drive unit and its controller can actively inflate and deflate different segmentation patterns in order to achieve compression of the sternal region with a non-uniform pattern of force and/or timing. In a further embodiment, combinations of subcompartments may be actively inflated and/or deflated so as to achieve alternative anatomic patterns of chest compression and/or decompression. Compression and decompression of specific sub-regions of the patient's sternum can increase efficacy of the CPR. Incorporation of selective sub-compartment sternal compression and/or decompression in addition to circumferential constriction and/or circumferential decompression may be determined adaptively based on biomarker closed-loop feedback. The specific sub-compartments that are incorporated into each CPR cycle can be determined by the controller in response to biological feedback. The optimal selective compartment of the sternal pneumatic bladder may be identified by an adaptive "play the winner" heuristic based on measurement of a biomarker, and may change over time during resuscitation.

By way of non-limiting example, a "play the winner" heuristic can mean that the after a predetermined length of time, such as 30 seconds or a minute, the system can switch to a different compartment or location for a predetermined length of time, such as 30 seconds, and can determine based on feedback measurements whether the new compartment results in improved or decreased efficacy, and the most efficacious compression/decompression location can be the winner (i.e. the best location). After the winner is used for a predetermined length of time, such as 30 seconds or a minute, the system can switch to a different location for a predetermined length of time, such as 30 seconds, and can continue to iteratively repeat the "play the winner" system based on feedback measurements.

In various embodiments, the controller can actively inflate and deflate different subcompartments, and can compare the performance of different subcompartments to determine the most effective subcompartments. In various embodiments, the controller can adjust various parameters of the CPR system and can compare the performance of the CPR system under different parameters to determine the most effective parameters. The adjusted parameters can include adjusting any of the parameters explained above, including compression and/or decompression parameters of the constriction vest and/or compression and/or decompression parameters of the sternal bladder, and the performance of the entire CPR system can be evaluated using the various parameter sets so that the controller can improve the parameters that are used on each patient, based on the biological feedback. By way of non-limiting example, the biological feedback used to determine the effectiveness of various sets of parameters can include forward blood flow and oxygen perfusion. The "play the winner" heuristic can include comparing two different sets of parameters to determine a winning set of parameters, and then trying a third set of parameters and comparing them to the previous winner to determine the new winner. The process of determining a winner and using the winning parameters, combined with trying new parameters and determining the new winner from between the new parameters and the old winner can be performed repeatedly to continue to improve the parameters in a way that is tailored to each individual patient.

Figure 11:
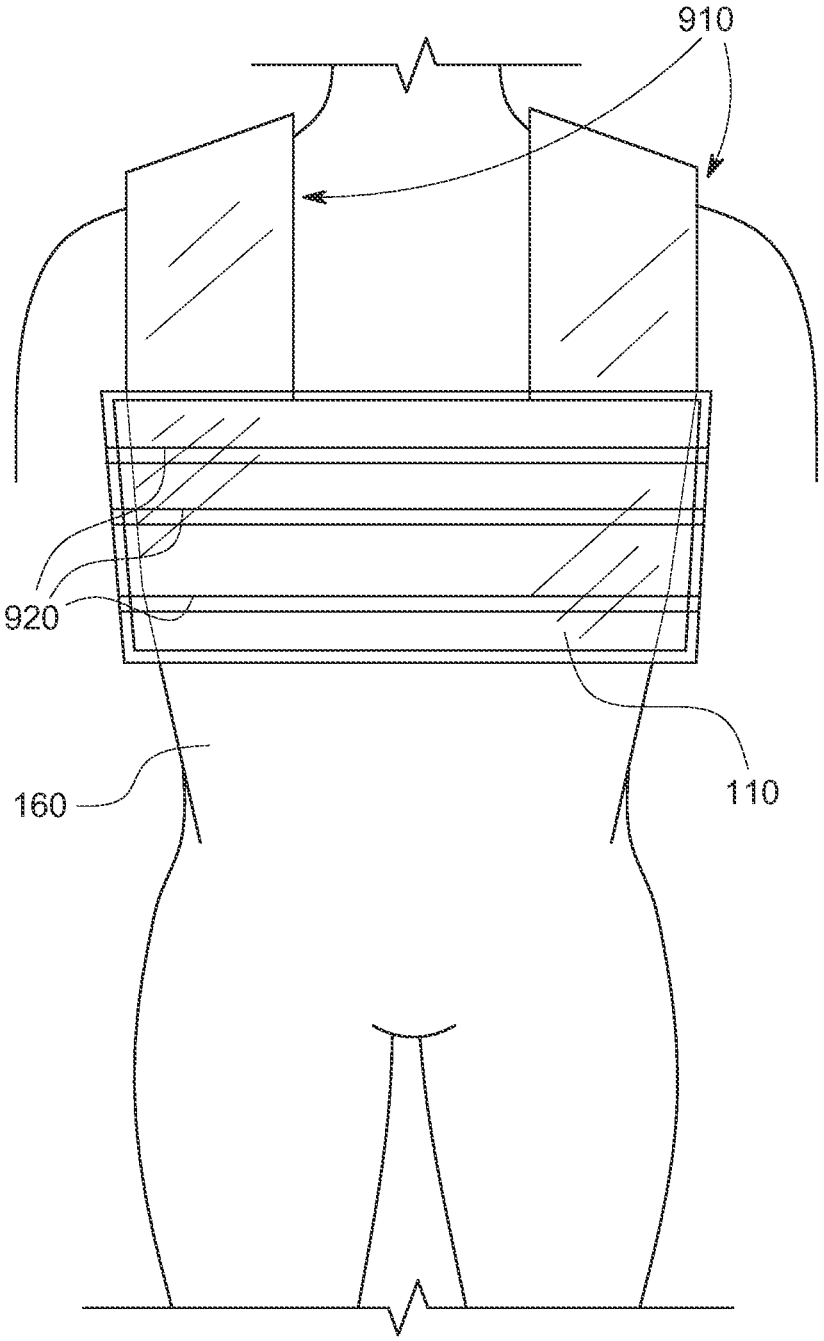
FIG. 11 is a top view of a patient with a circumferential constriction CPR system having a shoulder bladder, according to an illustrative embodiment.

FIG. 11 is a top view of a patient with a circumferential constriction CPR system having shoulder bladders 910, according to an illustrative embodiment. The efficacy of the circumferential constriction CPR vest may be enhanced by addition of pneumatic shoulder bladders 910 that also compress the clavicular, supraclavicular and suprascapular anatomic regions. The shoulder bladders 910 can extend from the front of the vest, over the shoulders of the patient, and connect to the back of the vest. These shoulder bladders 910 can be actively inflated and actively deflated to increase the efficacy of the CPR by preventing loss of intrathoracic pressure.

In various embodiments, the vest 110 can also have a series of ribs 920 that can be embedded within, or affixed to the outside of the vest 110. The ribs 920 can partially encircle or entirely encircle the vest to provide rigidity so that the vest can pull outwards on the patient. The ribs 920 can provide rigidity to the vest in addition to, or in place of, a cuirass. The ribs can be inflatable, or can be made from a rigid, springy, and/or resilient material. The ribs can be curved around the patient so that the interior of the rib is convex around the patient. In a resting state, the ribs can have a shape that curves away from the center of the patient's chest. This curve in the ribs can increase the ability of the ribs to provide a counterforce to the vest during active decompression, and can increase the ability of the ribs to store energy during the compression phase of the cycle to be released in the decompression phase of the cycle in order to contribute to the decompression.

Figure 12:
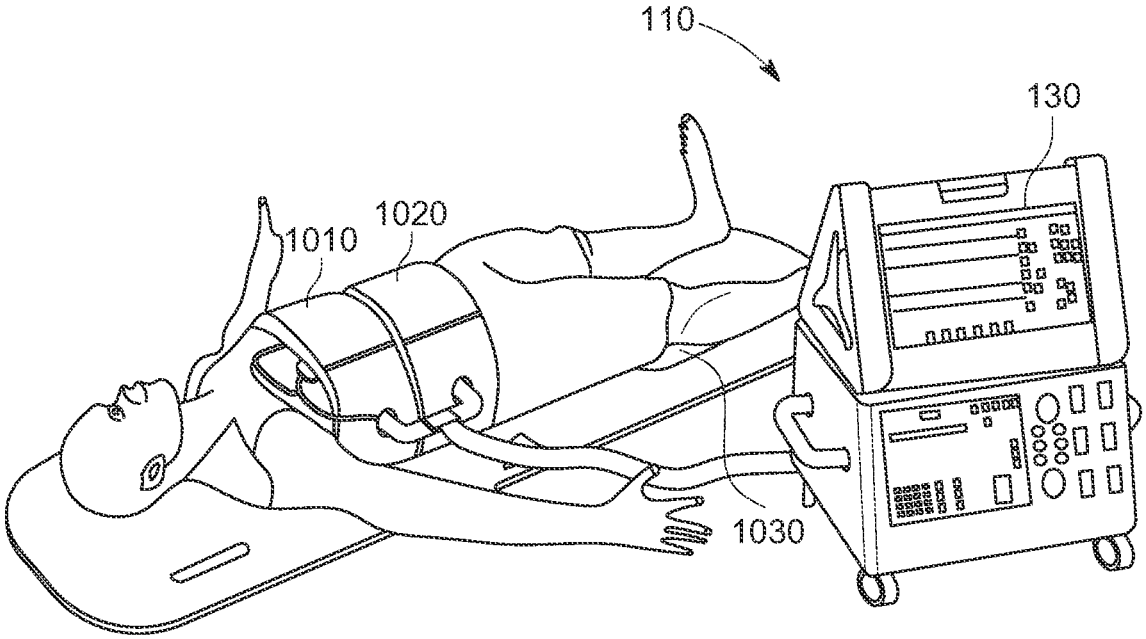
FIG. 12 is a perspective view of a patient with a circumferential constriction CPR system having a thoracic vest and an abdominal vest, according to an illustrative embodiment.

FIG. 12 is a perspective view of a patient with a circumferential constriction CPR system having a thoracic vest and an abdominal vest, according to an illustrative embodiment. Active constriction and active decompression of both the thorax and the abdomen can increase efficacy of the CPR. In various embodiments, the CPR system 100 can have a thoracic CPR vest 1010 and an abdominal CPR vest 1020. Each of the two vests can inflate for constriction and deflate for active decompression separately from the other. In various embodiments, the controller 130 can control the inflation and deflation of the thoracic CPR vest 1010, and the inflation and deflation of the abdominal CPR vest 1020. In various embodiments, the controller 130 can have a single pneumatic drive unit that drives the inflation and deflation of the thoracic CPR vest 1010, the abdominal CPR vest 1020, and can drive the inflation of the cuirass structure. In various embodiments, the controller 130 can have one, two, three, or more pneumatic drive units that drive the inflation and deflation of the thoracic CPR vest 1010, the abdominal CRP vest 1020, and the inflation of the cuirass structure.

The control unit 130 can synchronize the inflation and deflation of the thoracic vest 1010 and the abdominal vest 1020. The vests can inflate and deflate simultaneously, or the inflation and/or deflation of the vests can occur phasically at different points in the CPR cycle. The specific times during each cycle that the thoracic vest and the abdominal vest inflate and deflate can be determined by the controller based on biological feedback. The controller can use a play-the-winner system to determine the best timing for each of the components of the cycle, and can adapt the timing of the components in the cycle in response to changing biological feedback. In one embodiment, the abdominal vest can inflate first, followed by the inflation of the thoracic vest, followed by the forceful deflation of the abdominal vest and then the thoracic vest, however, various possible timings are possible. In various embodiments, the effectiveness of mechanical CPR can be further enhanced by static or phasic alterations in the patient's body position or a portion of the patient's body, including the head, neck, chest, abdomen, arms, and/or legs. By way of example, elevating the patient's upper body may enhance venous drainage from the head and improve cerebral blood flow. One or more body motion bladders 1030 can be positioned under or around portions of the patient's body so that inflation and deflation of the body motion bladders can alter the position of the patient's body.

It should be clear that the control unit 130 can adapt the parameters of the inflation and deflation of any of the above vests and bladders based on biological feedback. The parameters that can be adjusted by the control unit can include any of the parameters described herein, including the selections of bladders and vests to be inflated and deflated within a cycle, the timing of the inflations and deflations within each cycle, and the force, depth, speed, and other parameters of the inflation and deflation of the vests and bladders that are inflated and deflated within a cycle.

In various embodiments, the CPR system can include a single circumferential vest, a thoracic vest and an abdominal vest, a sternal bladder, a sternal bladder with subcompartments, and/or shoulder bladders, or various combinations of these components. With respect to active deflation of any of these vests or other bladders, it will be appreciated by one of ordinary skill in the art that this can be accomplished by true vacuum or relative vacuum, as long as the difference in pressure is achieved by the expenditure of energy. Relative vacuum may be either a pressure lower than the pressure in the inflated vest or lower than the atmospheric pressure. Active relative vacuum is the achievement of this lower pressure by expenditure of energy, force or work. Active vacuum can be created through work exerted by the pneumatic drive.

Figure 13:
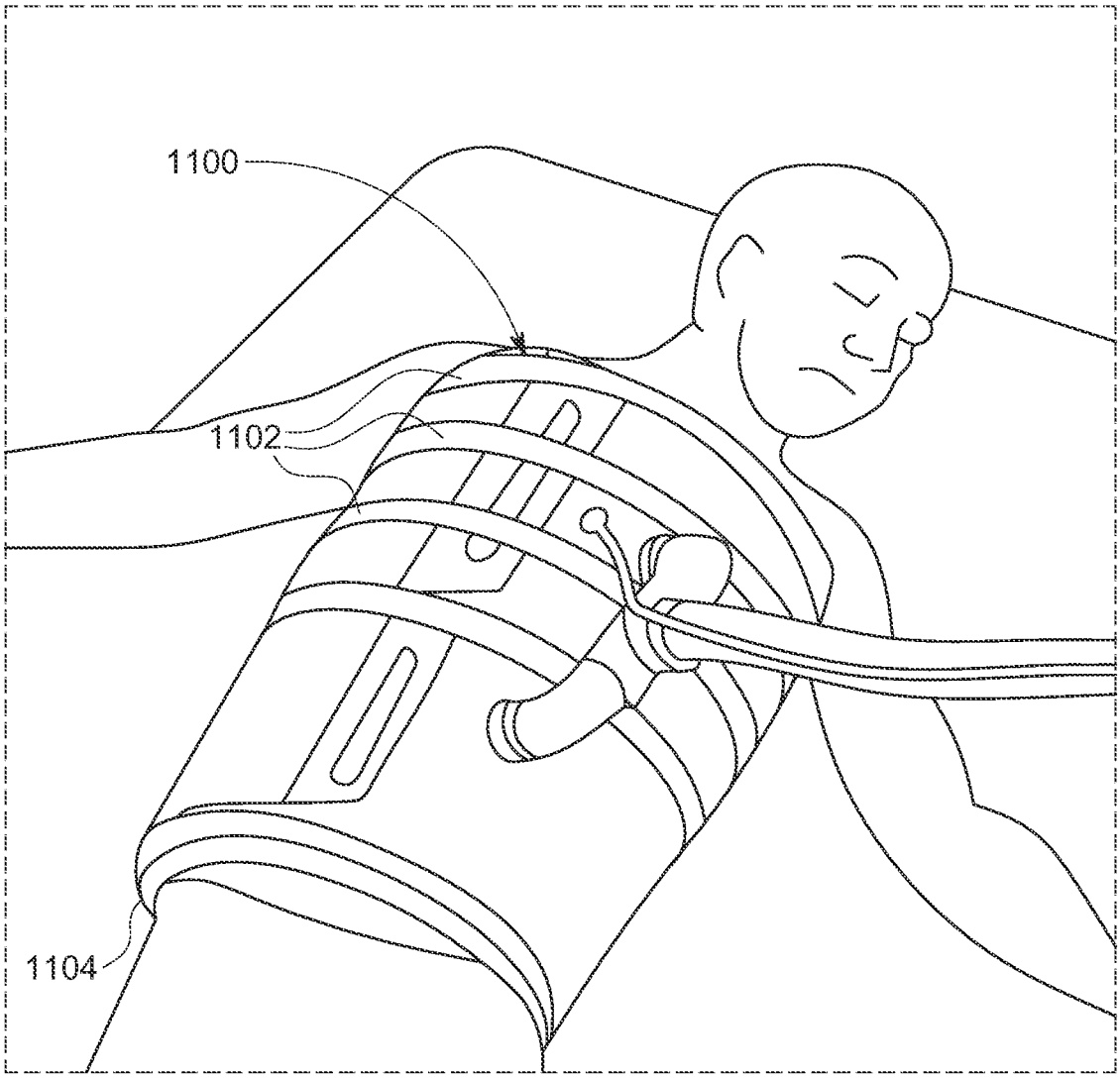
FIG. 13 is a perspective view of a patient with a circumferential constriction CPR system having structural hoops, according to an illustrative embodiment.

FIG. 13 is a perspective view of a patient with a circumferential constriction CPR system having structural hoops, according to an illustrative embodiment. In various embodiments, structural support for a cuirass 1100 can come from hoops 1102. Hoops 1102 can provide structure to the cuirass, which allows the cuirass to provide support to the CPR vest(s) 1104 so that the vests can pull outward on the patient during active decompression. In various embodiments, the hoops can be made from a rigid material, or the hoops can be resilient with elastic spring recoil so that they can flex slightly and absorb energy during the beginning of the active deflation portions of the CPR cycle and then return the stored energy at the end of the deflation portions of the CPR cycle by pulling upwards or outwards on the thorax of the patient. In various embodiments, the hoops 1102 can be pneumatic bladders that can be inflated when the cuirass function is required. In various embodiments, circumferential hoops 1102 can be flexible so that they can flatten under/behind the patient, and can expand above and alongside the patient.

In various embodiments, the hoops 1102 can entirely encircle the patient. In various embodiments, the hoops can partially encircle the patient, and can be connected to a backboard on both ends of the hoop so that the hoops can be quickly installed around the patient after the patient has been placed on the backboard. In various embodiments, the hoops can be elliptic, and the axis between the focal points of the ellipse can pass through the patient from side to side, so that the side to side distance within the hoop is greater than the top-to-bottom distance within the hoop. In various embodiments, the thoracic vest may have hoop guides such that the hoops may be easily inserted into their correct positions. The hoops themselves may be pre-arranged in an inserter gantry such that more than one hoop can be inserted into the vest with a single motion.

The hoops 1102 can be perpendicular to the patient's length, or long axis, and can be arrayed between the sternal notch and the xiphoid. The number of hoops and distance between hoops can be variable, and can depend on the support needed to provide active decompression of the thorax. In various embodiments, the hoops can be integrated within a cuirass, and/or can be attached to the outer surface of a thoracic pneumatic constriction vest to form a cuirass. In various embodiments, the hoops can be installed in the CPR system before the CPR system is placed around a patient. In various embodiments, the hoops can be inserted into the CPR system after the system is placed around the patient.

Usefulness of the Disclosed Invention.

Once it is understood and appreciated that the invention disclosed herein is for a method to improve CPR hemodynamics and the clinical outcome of patients suffering cardiac arrest, the usefulness will be manifest to anyone with ordinary skill in the art.

Non-Obviousness

The non-obviousness of the invention herein disclose is clear from the complete absence of its appreciation or discussion in the medical literature. Additionally, a number of large commercial enterprises produce devices for mechanical CPR; despite extensive research and development enterprises, none of these companies have disclosed or developed methods or systems such as disclosed herein.

Modifications

It will be understood that many changes in the details, materials, steps and arrangements of elements, which have been herein described and illustrated in order to explain the nature of the invention, may be made by those skilled in the art without departing from the scope of the present invention. Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents. More generally, the foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, various arrangements and combinations of cuirass are possible, including inflatable cuirass that also includes non-inflatable rigid ribs for additional support. Also, as used herein, the terms "process" and/or "processor" should be taken broadly to include a variety of electronic hardware and/or software based functions and components (and can alternatively be termed functional "modules" or "elements"). Moreover, a depicted process or processor can be combined with other processes and/or processors or divided into various sub-processes or processors. Such sub-processes and/or sub-processors can be variously combined according to embodiments herein. Likewise, it is expressly contemplated that any function, process and/or processor herein can be implemented using electronic hardware, software consisting of a non-transitory computer-readable medium of program instructions, or a combination of hardware and software. Additionally, as used herein various directional and dispositional terms such as "vertical", "horizontal", "up", "down", "bottom", "top", "side", "front", "rear", "left", "right", and the like, are used only as relative conventions and not as absolute directions/dispositions with respect to a fixed coordinate space, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances of the system (e.g. 1-5 percent). Accordingly, this description is meant to be taken only by way of example, and not to otherwise limit the scope of this invention.

Other Publications Incorporated in the Current Application by Reference as useful background information include the following:

REFERENCE LIST

CARDIAC ARREST—The Science and Practice of Resuscitation Medicine. Ed. N. A. Paradis, H. R. Halperin, and R. M. Nowak. 1 ed. Baltimore: Williams & Wilkins, 96 A.D.

Aufderheide, T. P., et al. "Clinical evaluation of an inspiratory impedance threshold device during standard cardiopulmonary resuscitation in patients with out-of-hospital cardiac arrest." Crit Care Med. 33.4 (2005): 734-40.

Barkalow, B. H. "Comparison of miniaturized pneumatic chest compressor to Thumper." Resuscitation 79.3 (2008): 509.

Cohen, T. J., et al. "Active compression-decompression. A new method of cardiopulmonary resuscitation. Cardiopulmonary Resuscitation Working Group [see comments]." JAMA 267 (1992): 2916-23.

Halperin, H. R., et al. "Cardiopulmonary resuscitation with a novel chest compression device in a porcine model of cardiac arrest: improved hemodynamics and mechanisms." J. Am. Coll. Cardiol. 44.11 (2004): 2214-20.

Halperin, H. R., et al. "A preliminary study of cardiopulmonary resuscitation by circumferential compression of the chest with use of a pneumatic vest." N. Engl. J. Med. 329 (1993): 762-68.

Kouwenhoven, W. B., J. R. Jude, and G. G. Knickerbocker. "Closed Chest Cardiac Massage." JAMA 173 (1960): 1064-67.

McDonald, J. L. "Systolic and mean arterial pressures during manual and mechanical CPR in humans." Ann Emerg. Med 11 (1982): 292-95.

Niemann, J. T., et al. "Cough-CPR: documentation of systemic perfusion in man and in an experimental model: a "window: to the mechanism of blood flow in external CPR." Crit Care. Med 8 (1980): 141-46.

Ong, M. E., et al. "Use of an automated, load-distributing band chest compression device for out-of-hospital cardiac arrest resuscitation." JAMA 295.22 (2006): 2629-37.

Paradis, N. A. "Is this the next step for CPR?" Am. J. Emerg. Med. 34.1 (2016): 97-99.

Paradis, N. A., et al. "Coronary perfusion pressure during external chest compression in pseudo-EMD, comparison of systolic versus diastolic synchronization." Resuscitation 83.10 (2012): 1287-91.

Plaisance, P., K. G. Lurie, and D. Payen. "Inspiratory impedance during active compression-decompression cardiopulmonary resuscitation: a randomized evaluation in patients in cardiac arrest." Circulation 101.9 (2000): 989-94.

Plaisance, P., et al. "Use of an inspiratory impedance threshold device on a facemask and endotracheal tube to reduce intrathoracic pressures during the decompression phase of active compression-decompression cardiopulmonary resuscitation." Crit Care Med. 33.5 (2005): 990-94.

Ralston, S. H., C. F. Babbs, and M. J. Niebauer. "Cardiopulmonary resuscitation with interposed abdominal compression in dogs." Anesth. Analg. 61 (1982): 645-51.

Rudikoff, M. T., et al. "Mechanisms of Blood Flow During Cardiopulmonary Resuscitation." Circulation 61 (1980): 345-52.

What is claimed is:

1. A cardiopulmonary resuscitation (CPR) device to provide active forceful decompression of the thorax during circumferential constriction CPR, the CPR device comprising:

an at least partially circumferential pneumatic constriction bladder vest adapted to surround the thorax of a patient;

an inflatable cuirass structure external to the circumferential constriction pneumatic bladder vest, the inflatable cuirass structure including a pneumatic cuirass bladder that becomes rigid upon inflation to form the inflatable cuirass;

a pneumatic drive unit configured to provide a forceful compression of the patient by forceful inflation of the bladder vest and configured to provide a forceful decompression of the patient by forceful deflation of the bladder vest, wherein forceful deflation of the bladder vest results in an outward pulling force on the patient, wherein the inflatable cuirass structure provides support that allows the circumferential constriction pneumatic bladder vest to apply an outward pulling force on the patient.

2. The CPR device of claim 1, wherein the cuirass structure further comprises material with intrinsic elastic spring recoil, said recoil adapted to provide active forceful decompression.

3. The CPR device of claim 2, wherein the elastic cuirass structure further comprises a resting state incorporating a shape that is adapted to curve away from the center of the patient's chest.

4. The CPR device of claim 1, wherein the vest further comprises pneumatic bladders or straps adapted to encompass supraclavicular regions or shoulder regions on either side of a neck of the patient.

5. The CPR device of claim 1, further comprising a sternal pneumatic bladder adapted to be positioned over the sternal area of the anterior chest, and wherein the sternal bladder selectively inflated and deflated separately from the vest, wherein the sternal bladder has have a sternal bladder cuirass to provide a component of active decompression separate from the circumferential constriction vest.

6. The CPR device of claim 5, further comprising a controller configured to synchronize the active inflation of the sternal pneumatic bladder with the active inflation and active deflation of the circumferential pneumatic vest, wherein the synchronization is selectively simultaneous or has specific phasic offsets.

7. The CPR device of claim 5, wherein the sternal pneumatic bladder further comprises a rigid outer shell on a vest side of the sternal pneumatic bladder.

8. The CPR device of claim 1, wherein the circumferential constriction bladder vest further comprising a plurality of sub-chambers, wherein one or more of the sub-chambers are selectively inflated and deflated by the pneumatic drive unit.

9. The CPR device of claim 1, wherein the forceful deflation of the vest is synchronized with an active compression of the abdomen, wherein the synchronization is selectively simultaneous or has specific phasic offsets.

10. The CPR device of claim 1 further comprising an impedance threshold device, wherein the forceful deflation of the vest is synchronized with the impedance threshold device.

11. The CPR device of claim 1, further comprising one or more sensors in a patient facing surface of the vest, wherein a force of the deflation of the vest is adjusted based on measurements originating from the sensors, wherein the sensors are one or more of: an electrocardiogram, an accelerometer, a force transducer, an ET-CO2 sensor, a SPO2 sensor, an impedance measurement sensor, and/or an acoustical microphone.

12. The CPR device of claim 1, wherein the cuirass structure further comprises a frame, the frame comprising a backboard and an upper shell, wherein circumferential pneumatic vest is attached to the frame.

13. The CPR device of claim 1, further comprising one or more sensors in a patient facing surface of the vest, and further comprising a controller, wherein the controller is configured to adapt parameters of the forceful inflation of the vest based on sensed biologic feedback, wherein the adapting the parameters of the forceful inflation of the vest comprises at least one of the following: greater force/speed, greater distance of constrictions, more frequent constrictions, shortened relaxation phases, prolonged decompression phase, and airway occlusion during decompression.

14. The CPR device of claim 1, further comprising one or more sensors in a patient facing surface of the vest, wherein the forceful deflation of the vest is adapted to provide greater decompressive force, greater decompressive speed, more frequent decompressions, prolonged decompression phase relative to compression phase, lessened active decompression, decreased force of decompression, decreased speed of decompression, or shortened decompression phase based on sensed biologic feedback.

15. The CPR device of claim 1, further comprising an impedance threshold device, wherein ventilation patterns are adapted to be altered in phase with the active decompression of the thorax.

16. The CPR device of claim 1, wherein the forceful inflation or deflation of the vest is further enhanced by phasic alteration in the patient's body position or a portion of the patient's body chosen from a list that includes the head, neck, chest, abdomen, arms or legs.

17. The CPR device of claim 1, further comprising a sternal pneumatic bladder that incorporates sub-compartments that are selectively actively inflated and/or deflated.

* * * * *